US005746014A

United States Patent [19]

Tanemoto

[11] Patent Number: 5,746,014

[45] Date of Patent: May 5, 1998

[54] SLIPPER

[76] Inventor: Yoshihisa Tanemoto, 701, Nishijima, Shizouka-shi, Shizuoka-ken, Japan

[21] Appl. No.: 587,149

[22] Filed: Jan. 16, 1996

[30] Foreign Application Priority Data

May 1, 1995 [JP] Japan ..... 7-107647
Aug. 9, 1995 [JP] Japan ..... 7-203018

[51] Int. Cl.[6] ..... A43B 3/12; A43B 13/28

[52] U.S. Cl. ..... 36/11.5; 36/12; 36/21; 36/8.1

[58] Field of Search ..... 36/11.5, 7.5, 12, 36/21, 8.1, 9 R; 12/142 S

[56] References Cited

U.S. PATENT DOCUMENTS

| | | | |
|---|---|---|---|
| 2,032,206 | 2/1936 | Goldberg | 36/11.5 |
| 2,317,870 | 4/1943 | Weinstat | 36/11.5 |
| 2,364,763 | 12/1944 | Sutcliffe | 36/11.5 |
| 2,932,911 | 4/1960 | Musebeck et al. | 36/11.5 |
| 2,971,278 | 2/1961 | Scholl | 36/11.5 |
| 2,978,817 | 4/1961 | Brenner | 36/11.5 |
| 3,221,422 | 12/1965 | Lemeshnik | 36/9 R |
| 3,323,233 | 6/1967 | Scholl | 36/11.5 |
| 3,596,381 | 8/1971 | Fukuoka | 36/11.5 |
| 3,841,003 | 10/1974 | Huyge | 36/11.5 |
| 4,586,209 | 5/1986 | Bensley | 36/11.5 |

FOREIGN PATENT DOCUMENTS

| | | | |
|---|---|---|---|
| 128314 | 7/1948 | Australia | 36/11.5 |
| 820906 | 4/1937 | France | 36/11.5 |
| 1331570 | 5/1962 | France | 36/11.5 |
| 57184603 | 5/1956 | Japan . | |
| 60-153201 | 12/1985 | Japan . | |
| 670804 | 3/1994 | Japan . | |
| 564960 | 10/1944 | United Kingdom | 36/11.5 |
| 734833 | 8/1955 | United Kingdom | 36/11.5 |

*Primary Examiner*—M. D. Patterson
*Attorney, Agent, or Firm*—Price, Gess & Ubell

[57] ABSTRACT

A slipper having an upper sheet 4 and a lower sheet 5, which are adhered together to form a sole. To the upper sheet 4 are attached two band parts 6L and 6R which can be folded parallely against upper sheet 4. Attachment slots 7, into which the lateral edges of band parts 6L and 6R can be inserted, are also provided on upper sheet 4. Furthermore, an auxiliary sheet 8 is provided between upper sheet 4 and lower sheet 5 so as to be in contact with the lower faces of band parts 6L and 6R, which have been inserted into attachment slot 7, and the lower face of upper sheet 4. The auxiliary sheet 8 and the lateral edges of band parts 6L and 6R are sewn together along attachment slot 7 by means of stitch 9.

13 Claims, 22 Drawing Sheets

SLIPPER

BACKGROUND OF THE INVENTION

1. Field of the Invention

The present invention relates to slippers which have a sole and an instep band and particularly to a slipper in which the structure by which the instep band is attached to the sole has been improved and the instep band has been made foldable.

2. Description of Related Art

In general, slippers are widely used as indoor footwear and several types of slippers have been proposed. For example, the slipper shown in FIG. 24 is a thin type in which the instep band 2, which is attached to the sole 1 on which the foot is placed, is arranged to be folded against the upper face (top) side of the sole 1. Since the instep band 2 is foldable, such a slipper can exhibit excellent storability and is not only preferable for use at hotels, etc., where large quantities of slippers must be stored, but is also highly demanded as a portable slipper.

Meanwhile, from the standpoint of effective use of resources, disposable slippers are becoming avoided. Slippers, that are provided with adequate waterproofness to enable water washing and thus repeated use, are thus being demanded. Washing needs to be performed especially frequently in hotels, hospitals, and other environments where sanitation is important. Waterproofness and quick drying properties are thus demanded of slippers. Furthermore slippers that will not become deformed upon washing are desired.

In general slippers, the sole and the instep band are attached together as shown in FIG. 25. That is, the sole 1 and the instep band 2 were adhered together by an adhesive agent and then the outer peripheral parts of both were stitched together by a stitch 30. In such a slipper, the stitch 30 is exposed at the lower face of sole 1 and at the upper face of instep band 2. Stitch 30 may thus become frayed after the slipper has been used for a long period of time. The wear is particularly severe and the chances of fraying are particularly high for the parts of stitch 30 which protrude below the lower face of sole 1 and in constant contact with the floor surface. Improved durability has been therefore sought in this field.

Also with the abovementioned slipper, holes are formed in sole 1 and instep band 2 for stitch 30. Moisture could therefore enter inside sole 1 or instep band 2 from such holes and such slippers were therefore low in waterproofness.

With conventional slippers shown in FIG. 24, in which an instep band is folded, the instep band tended to fold naturally each time the slipper was taken off. This was due to the creases that form on the instep band when it is folded and to the elasticity of the instep band. The instep band therefore had to be raised each time the slipper was worn, which was troublesome.

Furthermore, slippers are usually fixed in size and the size of the instep band cannot be adjusted according to the foot size of each person. Thus, when slippers of the same size are worn by different people, they tend to slip off during walking in the case of users with narrow foot width and low instep and tend be too tight for users with wide foot width and high instep. Such slippers were thus uncomfortable for both types of users.

SUMMARY OF THE INVENTION

The present invention has been made in view of such circumstances and the main object thereof is to present slippers with improved durability and waterproofness. A further object of the present invention is to present slippers which can ensure comfortable wearing and are provided with improved portability and storability.

In order to achieve the above object, the invention presents a slipper with a sole and an instep band attached to this sole, said slipper being characterized in that the sole is comprised of an upper sheet and a lower sheet, attachment slots, into which the lateral edges of the instep band are insertable, are formed on the upper sheet, an auxiliary sheet is provided between the upper sheet and the lower sheet, said auxiliary sheet being in contact with the lower face of the instep band inserted in the attachment slots and the lower face of the upper sheet, and a stitch, for sewing together the auxiliary sheet and the lateral edges of the instep band, is provided along each attachment slot.

With the invention of the above arrangement, since the stitch is provided along the attachment slot, the parts of the stitch which protrude from the upper face of the instep band may be kept within the depression of the attachment slot. That is, the parts of the stitch which protrude from the upper face can be prevented from protruding above the upper face of the upper sheet. Also, with this invention, the auxiliary sheet to which the stitch is sewn is covered at the lower side by the lower sheet of the sole. Therefore the parts of the stitch that protrude from the lower side of the auxiliary sheet will not be exposed from the lower face of the lower sheet. Both the stitch parts that protrude from the upper face of the instep band and the stitch parts that protrude from the lower face of the auxiliary sheet in this invention are therefore protected from wear. Therefore, the stitch will not wear out and the instep band will not become removed from the sole even if the slipper is used over a long period of time.

Furthermore with the present invention, the open parts of the attachment slots may be covered with the auxiliary sheet to prevent moisture from entering inside the sole from the attachment slots. The waterproofness of the slipper may thus be increased.

The invention presents a slipper with a sole and an instep band attached to this sole, said slipper being characterized in that the sole is comprised of an upper sheet and a lower sheet, attachment slots, into which the lateral edges of the instep band are insertable, are formed in the upper sheet, an auxiliary sheet is provided between the upper sheet and the lower sheet, said auxiliary sheet being in contact with the lower face of the instep band inserted in the attachment slots and the lower face of the upper sheet, and a welded part, for adhering the auxiliary sheet and the lateral edges of the instep band together, is provided along each attachment slot.

With the invention of the above arrangement, the welded part formed on the auxiliary sheet will not be exposed from the lower face of the sole since they are covered at the lower side by the lower sheet. Therefore the welded part will not undergo wear and the instep band will not become removed from the sole.

Also, with this invention, since stitches are not sewn to the auxiliary sheet and the lateral edges of the instep band, holes for the stitch are not opened in the auxiliary sheet and the instep band. Therefore, moisture will not enter inside the sole or the instep band through holes for stitches. The slipper by this invention can therefore exhibit excellent waterproofness.

In the invention, waterproofing parts are formed at the outer peripheral parts of the attachment slots and the outer peripheral part of the sole by weld-cutting.

With such a slipper, waterproofing parts can be formed at the outer peripheral parts of the attachment slots and the sole at the same time the attachmet slots and the sole are formed by weld-cutting. The attachment slots and sole can thus be waterproofed in a simple manner and any moisture that may tend to enter inside the sole from the attachment slots or the outer peripheral part of the sole may be blocked. The waterproofness of the slipper can thus be improved further.

In the invention, both the upper sheet and the lower sheet are comprised of a polyvinyl chloride sheet with a paste part.

Since such a slipper is made of polyvinyl chloride, it presents the benefit of being suitable for welding and antibacterial processing. Also, since a paste part is provided at the upper and lower sheets, high cushioning properties may be ensured for increased wearing comfort.

In the invention, the instep band is comprised of two band parts that can be folded parallely against the sole, said band parts being provided with joining means for joining the band parts together.

With the invention of the above arrangement, the entire slipper may be made to have a thin, sheet-like shape by parallely folding the band parts against the sole. Such a slipper is therefore convenient for storing in piles or for carrying. In wearing such a slipper, the folded band parts are raised together and then joined together to form single instep band from the two band parts. The length of the instep band may be adjusted in this process by changing the joining condition of the band parts. The length of the instep band may thus be made to fit the instep of the user.

In the invention, each of the two band parts is provided with a joining slot into which a part of the other band part is inserted, said joining slots being formed so that their front ends will come into contact with each other when the band parts are raised together.

With the invention of the above arrangement, the folded band parts are raised together when the slipper is worn. With the present invention, the two band parts become one instep band by the front ends of the joining slots coming into contact with each other. That is, since the front ends of the joining slots attachment position come in contact with each other when the two band parts are raised, the two parts become joined together at one point. The axial line extending from the toe side to the heel side of the instep band is thereby made rotatable up and down around this point of contact. The instep band can thus be turned in the vertical direction to match the instep height of the user when the user's foot is passed through the instep band. As a result, the instep band can always be made to fit the instep of a user regardless of the foot size of the user, the narrowness or wideness of the foot width, or the lowness or highness of the instep.

Also, with the invention, since joining slots were provided at the band parts themselves as a means of joining the band parts together, there is no need to provide a band joining means that is separate from the band parts. The band parts may thus be arranged in a simple manner. Furthermore with this invention, the entire slipper may be made to have a thin, sheet-like shape by parallely folding the band parts against the sole as in the invention of the fifth claim described above. The slipper may thus be provided with excellent portability and storability.

The invention presents a slipper with a sole and an instep band attached to this sole, said slipper being characterized in that the sole is comprised of a sheet-shaped core, a cushion member, which covers the upper and lower faces of this core, and a surface sheet, which covers the cushion member.

With the invention of the above arrangement, since the sole is arranged by providing a cushion member that covers both sides of a sheet-shaped core and this cushion member is covered by a surface sheet, the thickness of the sole may be made adequately thin. Furthermore, suitable cushioning can be ensured since a cushion member is provided inside the sole.

The invention presents a slipper with a sole and an instep band attached to this sole, said slipper being characterized in that the sole is comprised of first and second cushion members, which are adhered together, a sheet-shaped core, which is formed on at least either of the first and second cushion members, and a surface sheet, which covers the first and second cushion members.

With the invention of the above arrangement, since the sole is arranged by attaching a first and second cushion member to both sides of a sheet-shaped core and these cushion members are covered by a surface sheet, the thickness of the sole may be made adequately thin. Furthermore good cushioning can be ensured since two cushion members are provided inside the sole.

In the invention, a waterproofing means is provided at the outer peripheral part of the sole.

With the invention of the above arrangement, the waterproofness of the sole is ensured since a waterproofing means is provided at the outer periphery of the sole.

In the invention, the core and the surface sheet are comprised of polyvinyl chloride sheet, the cushion member is comprised of polyvinyl chloride paste formed by a paste foaming process, and the waterproofing means is formed by weld-cutting the core, the surface sheet, and the cushion member.

With the invention of the above arrangement, the outer periphery of the sole can be waterproofed at the same time the sole is weld-cut. Also, water repellency can be ensured for the entire sole since it is made of polyvinyl chloride. The slipper may thus be dried quickly since moisture can be wiped off readily even when the slipper gets wet. Furthermore, improved durability is provided since the core and the surface sheet are made from a polyvinyl chloride sheet.

In the invention, insertion slots, into which the end parts of the instep band are insertable, are formed on the outer peripheral parts of the first cushion member and the surface sheet covering the first cushion member, there being waterproofing parts formed at the insertion slots by the weld-cutting process performed when the insertion slots are opened, and the instep band is attached to the sole by inserting the end parts of the instep band through the insertion slots in a manner whereby the end parts are drawn to the outer side of the sole and then sandwiching the end parts between the first cushion member and the second cushion member to fix the instep band.

With the invention of the above arrangement, since the instep band is fixed upon drawing the end parts of the instep band towards the outer side of the sole when attaching the instep band to the sole, the end parts of the instep band may be prevented from becoming wavy even if the end parts are slightly curved. Since the instep band is thus prevented from becoming wavy, wrinkles will not form on the upper and lower faces of the sole even if the core, the first cushion member, and the surface sheet are thin. Furthermore, since a waterproofing part is formed at the insertion slot by weld-cutting, water will not enter inside the sole from the insertion slot parts and the waterproofness of the sole will be ensured.

The invention presents a slipper with a sole and an instep band attached to this sole, said slipper being characterized in that the instep band is comprised of two band parts that can be folded parallely against the sole, a band attaching means is provided for attaching the band parts to the sole, and the band parts are provided with a joining means for joining the band parts together when the band parts are raised together.

With the invention of the above arrangement, the entire slipper may be made to take on a thin, sheet-like shape by parallely folding the band parts against the sole. Slippers may thus be piled in large quantities and stored in a narrow space. Furthermore, wearing comfort is ensured when the slipper is worn since the joining means join the band parts together when the band parts are raised together to form a single instep band from the two band parts.

In the invention, the joining means is comprised of a joining hole, which is formed on one of the band parts, and an inserted part, which is formed on the other of the band parts and is insertable in the joining hole.

With the invention of the above arrangement, the joining means is formed integrally with the band parts by forming a joining hole on one of the band parts and forming a part that is insertable in this joining hole on the other band part. Thus, there is no need to provide the joining means as a means apart from the band parts and the structure of the band parts may be made simple.

In the invention, the band parts are provided with an adjusting means for adjusting the size of the part at which the band parts overlap and the joining means and the adjusting means are comprised of Velcro tape.

With the invention of the above arrangement, since the joining part is comprised of Velcro tape, the size of the instep band may be adjusted by changing the size of the part at which the band parts overlap and the band parts can then be joined together with the joining means to form an instep band of the desired size. The size of the instep band may thus be changed readily according to the foot size of the user.

In the invention, the cushion member included in the instep band is comprised of polyvinyl chloride paste formed by a paste foaming process and a waterproofing part is formed at the outer peripheral part of the instep band by the weld-cutting of the instep band.

With the invention of the above arrangement, since a waterproofing part can be formed at the outer peripheral part of the instep band by weld-cutting the instep band, the outer periphery of the instep band may be waterproofed at the same time the instep band is cut.

In the invention, the band parts are arranged so that they will not protrude from the outer peripheral part of the sole when they are folded against the sole.

With the invention of the above arrangement, the slipper can be made readily storable within a certain space and be improved further in portability and storability.

In the invention, a reinforcing sole is attached to the bottom of the sole so as to enable the slipper to be worn outdoors.

With the invention of the above arrangement, the slipper is made wearable outdoors by the attachment of a reinforcing sole to the bottom of the sole.

The invention presents a slipper with a sole and an instep band attached to this sole, said slipper being characterized in that the sole is comprised of an upper sheet and a lower sheet, attachment slots, into which the lateral edges of the instep band are insertable, are formed on the upper sheet, an auxiliary sheet is provided between the upper sheet and the lower sheet, said auxiliary sheet being in contact with the lower face of the instep band inserted in the attachment slots and the lower face of the upper sheet, a stitch, for sewing together the auxiliary sheet and the lateral edges of the instep band, is provided along each attachment slot, the instep band is comprised of two band parts that can be folded parallely against the sole, a band attaching means is provided for attaching the band parts to the sole, and the band parts are provided with a joining means for joining the band parts together when the band parts are raised together.

With the invention of the above arrangement, the parts of the stitch, which protrude outside the upper face of the instep band and which protrude outside the lower face of the auxiliary sheet, are protected from wear. Therefore the stitch will not become frayed and the instep band will not become removed from the sole even when the slipper is used over a long period of time.

Furthermore with this invention, since the open parts of the attachment slot can be covered by the auxiliary sheet, water can be prevented from entering inside the sole from the attachment slot and the waterproofness of the slipper can thus be improved.

The slipper may be stored in large quantities by piling in a narrow space upon parallely folding the band parts against the sole. Wearing comfort can also be ensured since the two band parts become a single instep band when the slipper is worn.

The invention presents a slipper with a sole and an instep band attached to this sole, said slipper being characterized in that the sole is comprised of an upper sheet and a lower sheet, attachment slots, into which the lateral edges of the instep band are insertable, are formed on the upper sheet, an auxiliary sheet is provided between the upper sheet and the lower sheet, said auxiliary sheet being in contact with the lower face of the instep band inserted in the attachment slots and the lower face of the upper sheet, a welded part, for adhering the auxiliary sheet and the lateral edges of the instep band together, is provided along the attachment slots, the instep band is comprised of two band parts that can be folded parallely against the sole, a band attaching means is provided for attaching the band parts to the sole, and the band parts are provided with a joining means for joining the band parts together when the band parts are raised together.

With the invention of the above arrangement, the welded part will not become worn and the instep band will not become removed from the sole.

Furthermore, with this invention, moisture will not enter inside the sole or the instep band through stitch holes. The slipper of this invention can thus exhibit excellent waterproofness.

Slippers may be piled together and stored in large quantities in a narrow space upon parallely folding the band parts against the sole. Wearing comfort can also be ensured since the two band parts become a single instep band when the slipper is worn.

In the invention, at least either of the upper and lower sheets is comprised of a sheet-shaped core, a cushion member, which covers the upper and lower faces of this core, and a surface sheet, which covers the cushion member.

With the invention of the above arrangement, since at least either of the upper and lower sheets, which comprise the sole, is arranged by providing a cushion member on both sides of a sheet-shaped core and covering the cushion member with a surface sheet, the thickness of the sole can be made adequately thin. Furthermore, suitable cushioning can be ensured since the interior of at least either of the upper and lower sheets is provided with a cushion member.

In the invention, at least either of the upper and lower sheets is comprised of first and second cushion members, which are attached together, a sheet-shaped core, which is formed on at least either of the first and second cushion members, and a surface sheet, which covers the first and second cushion members.

With the invention of the above arrangement, since at least either of the upper and lower sheets, which comprise the sole, is arranged by attaching a first and second cushion member to both surfaces of a sheet-shaped core and covering these cushion members with a surface sheet, the thickness of the sole can be made adequately thin. Furthermore, good cushioning can be ensured since two cushion members are provided at the interior of at least either of the upper and lower sheets.

DETAILED DESCRIPTION OF THE INVENTION

Preferred embodiments of the Invention

[1] First Preferred embodiment

Figure 1:
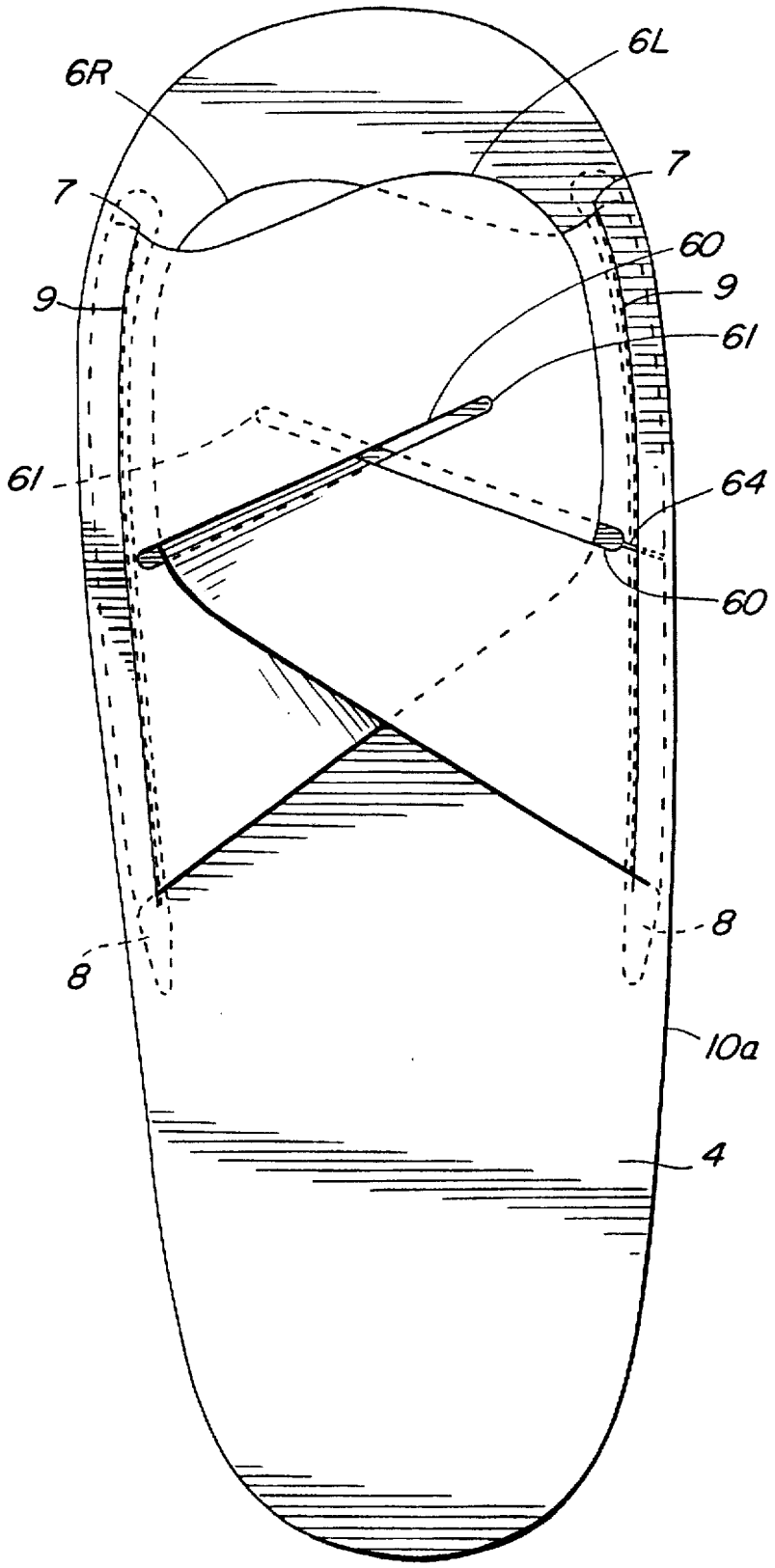
FIG. 1 is a plan view of the first preferred embodiment.
Figure 2:
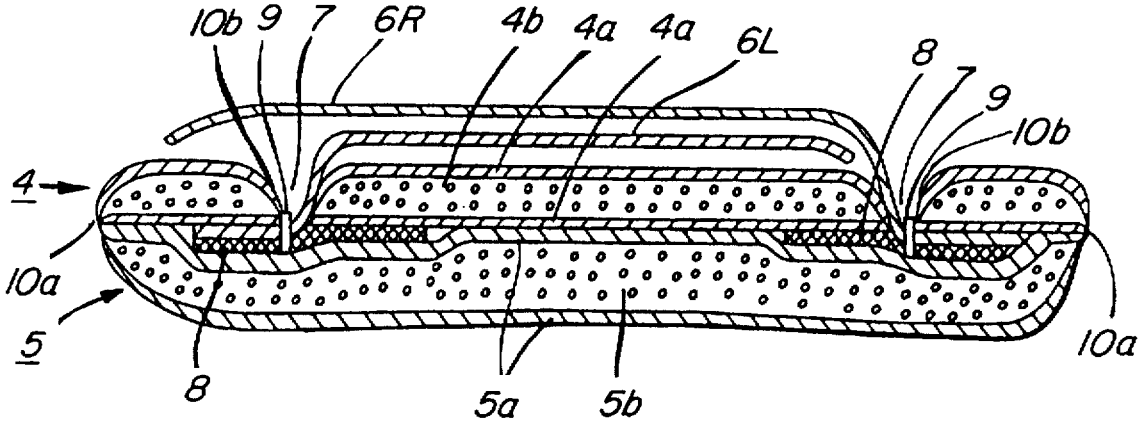
FIG. 2 is a cross-sectional view of the major parts of the first preferred embodiment.
Figure 3:
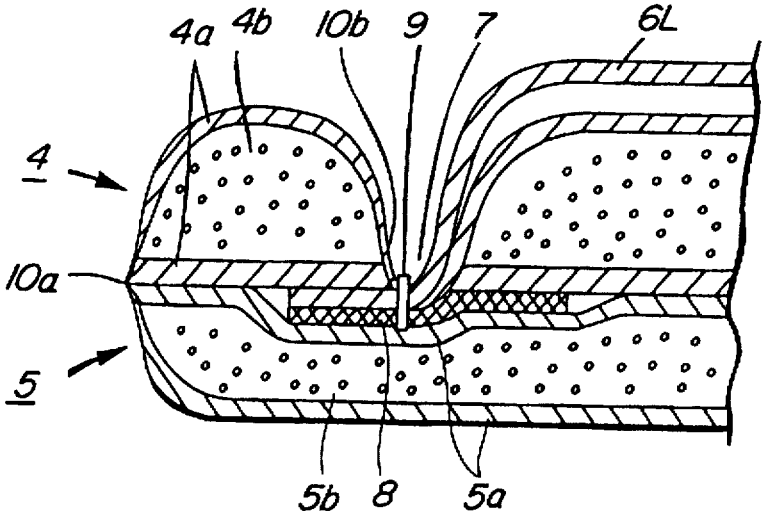
FIG. 3 is an enlarged cross-sectional view of the major parts of the first preferred embodiment.
Figure 4:
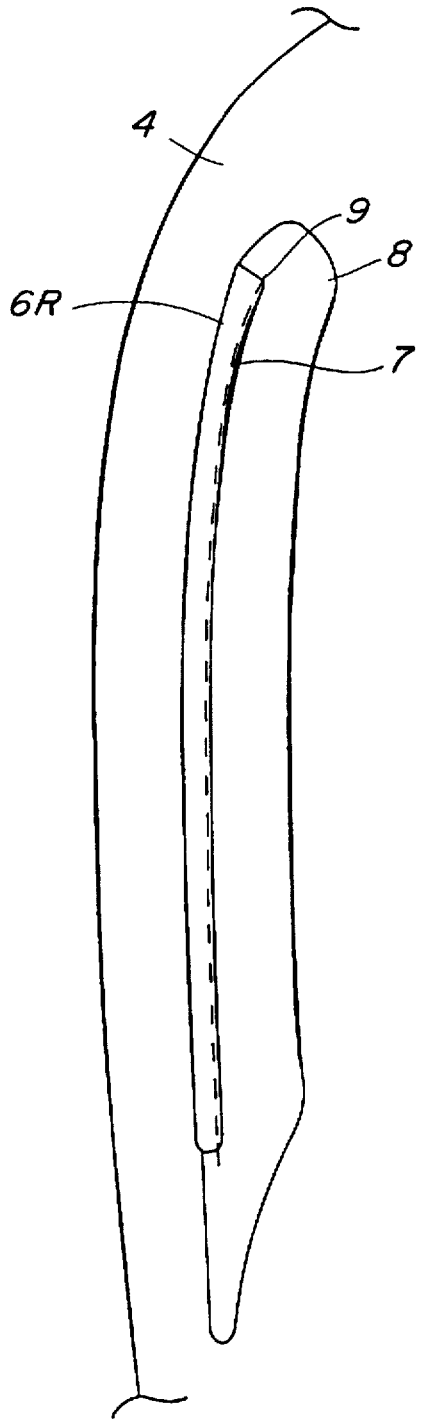
FIG. 4 is an enlarged bottom view of the major parts of the first preferred embodiment.
Figure 5:
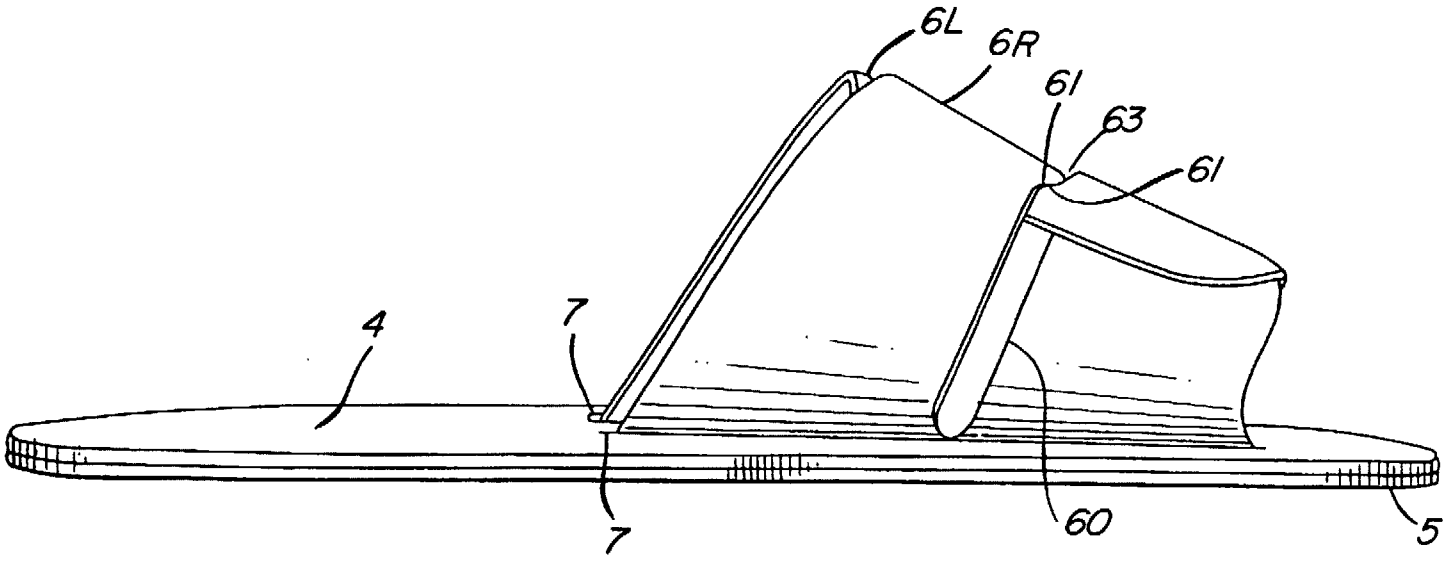
FIG. 5 is a side view of the first preferred embodiment.
Figure 6:
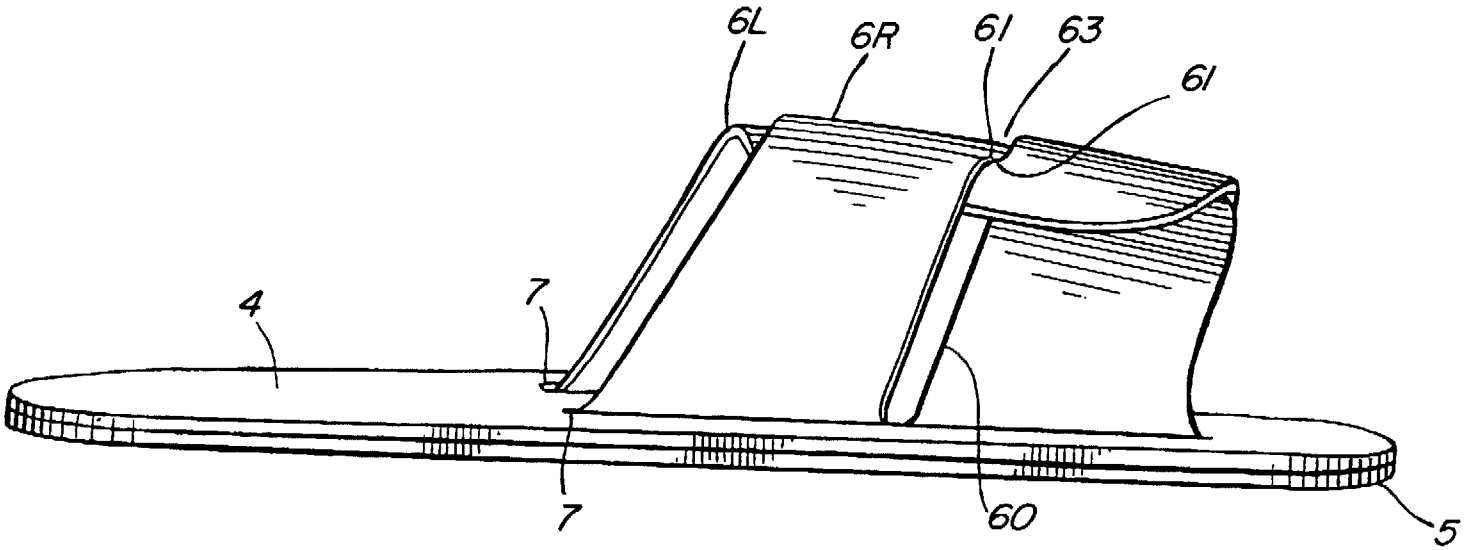
FIG. 6 is a side view of the first preferred embodiment.
Figure 7:
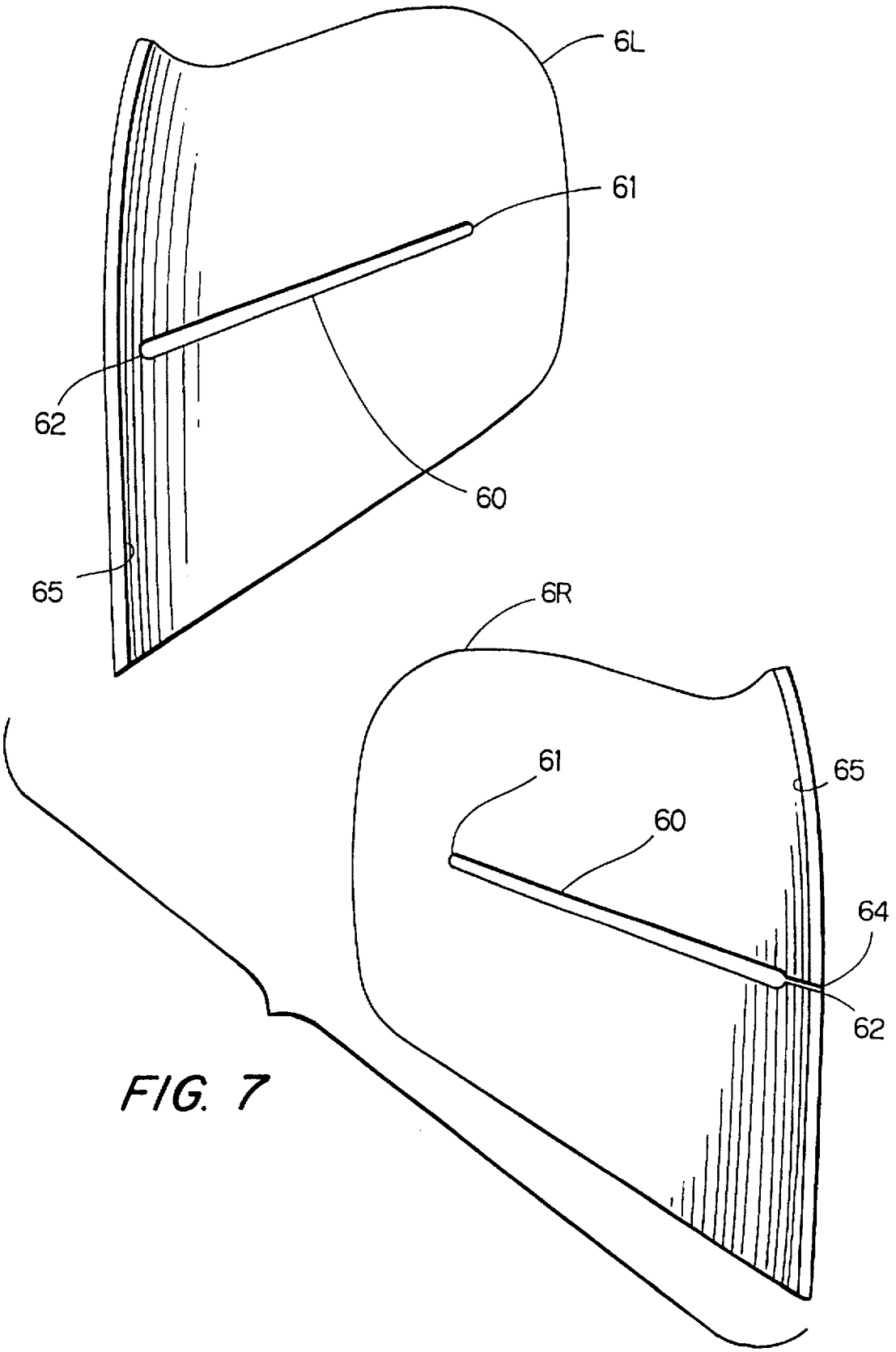
FIG. 7 shows plan views of the individual band parts.
Figure 8:
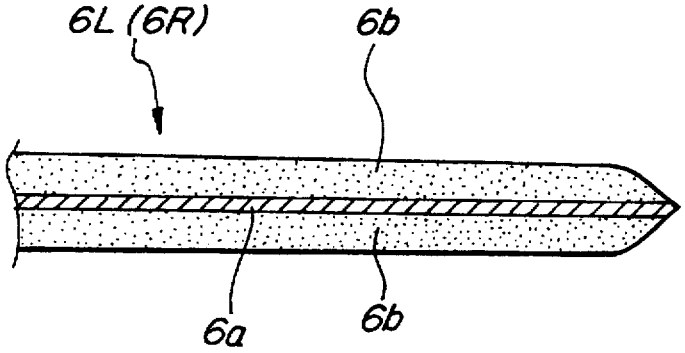
FIG. 8 shows cross-sectional views of the individual band parts.

The first preferred embodiment of the present invention shall now be described in detail with reference to FIGS. 1–8. FIG. 1 is a plan view of the first preferred embodiment, FIG. 2 is a cross-sectional view of the major parts of the first preferred embodiment, FIG. 3 is an enlarged cross-sectional view of the major parts of the first preferred embodiment, and FIG. 4 is an enlarged bottom view of the major parts of the first preferred embodiment. FIGS. 5 and 6 are side views of the first preferred embodiment. FIG. 7 shows plan views of the individual band parts and FIG. 8 shows cross-sectional views of the individual band parts. In the cross-sectional views of FIGS. 2 and 3, the thickness of the sole and the sheet members in the sole are illustrated thicker than they actually are so that the arrangement of the sole side may be understood more readily.

[1-1] Arrangement

[1-1-1] Outline of the Arrangement—Sole and Instep Band

As shown in FIG. 2, the slipper of this preferred embodiment is provided with an upper sheet 4 and a lower sheet 5, which are adhered together to form a sole, and two band parts 6L and 6R, which form the instep band and are foldable parallely against upper sheet 4. Among the above, upper sheet 4 and lower sheet 5 are arranged from polyvinyl chloride sheets that have the same shape and structure. This polyvinyl sheet is arranged by forming paste parts **4*b* and 5*b* at the interior of hard, thin top sheets 4*a* and 5*a*. Upper sheet 4 and lower sheet 5 are made into a certain size by weld-cutting and a waterproofing part 10*a* is provided at the outer peripheral parts of sheets 4 and 5** by this weld-cutting process.

Meanwhile, as shown in FIG. 8, band parts 6L and 6R have a thin polyester sheet **6*a* as the core member and a polyvinyl chloride sheet 6*b* is formed so as to cover this polyester sheet 6*a* from above and below. These band parts 6L and 6R are attached to the left edge and right edge of upper sheet 4 with their lateral edges pointing outward. Also, as shown in FIG. 1, joining slots 60 are provided near the central parts of band parts 6L and 6R so that band parts 6L and 6R may cross each other at an attachment position when they are folded against upper sheet 4. The joining slots 60 are joined so that their front ends 61 will come in contact with each other when band parts 6L and 6R are raised together in an arch-like manner. The point of contact of these front ends 61 is shown as 63 in FIGS. 5 and 6. The base ends 62 of joining slots 60 are disposed near the center of the lateral edges of band parts 6L and 6R**.

A slit 64, which extends to the base end 62 of joining slot 60, is formed at the lateral edge of band part 6R. Band part 6R thus takes on an arrangement that is partitioned into the toe-side part and the heel-side part due to the joining slot 60.

When joining slots 60 of band parts 6L and 6R are to be joined, the toe-side part of band part 6R is positioned below band part 6L and the heel-side part of band part 6R is passed from the lower side to the upper side of band part 6L through joining slot 60 of band part 6L. Band parts 6L and 6R are arranged so that they will not protrude from the outer peripheral part of upper sheet 4 when they are folded toward upper sheet 4. Furthermore, as shown in FIG. 7, guide lines 65, which are nearly parallel to the side edges of band parts 6L and 6R, are drawn by a weld process at the inner side of the slightly lateral edges of band parts 6L and 6R.

[1-1-2] Arrangement of the Structure for Attaching the Sole with the Instep Band—Attachment Slot and Auxiliary Sheet As shown in FIG. 4, attachment slots 7 are formed in a gradually curving manner along the lateral edges of upper sheet 4 at the left and right edges of the toe-side half of upper sheet 4. The length of attachment slot 7 is made slightly longer than the length of the lateral edges of band parts 6L and 6R so that the lateral edges of band parts 6L and 6R may be inserted smoothly. To give a specific example, when the length of the lateral edges of band parts 6L and 6R is set to approximately 110 mm, the length of the attachment slot 7 is set to be about 3–5 mm longer than the above length. Attachment slot 7 is formed by weld-cutting upper sheet 4 and a waterproofing part **10*b* is provided at the outer peripheral part of attachment slot 7** by this weld-cutting process.

Also as shown in FIGS. 1–4, an auxiliary sheet 8, made of polyvinyl chloride, is provided between upper sheet 4 and lower sheet 5. This auxiliary sheet 8 is brought in contact with the lower faces of band parts 6L and 6R and the lower face of upper sheet 4. Furthermore, auxiliary sheet 8 is sewn to the lateral edges of band parts 6L and 6R by means of stitch 9. The stitches 9 are provided along each attachment slot 7. As shown in FIGS. 1 and 4, the length of auxiliary sheet 8 is made longer that of attachment slot 7. As a specific example, when the length of attachment slot 7 is made approximately 3–5 mm longer than the length of the lateral edges of band parts 6L and 6R, the length of auxiliary sheet 8 is set to be about 10–15 mm longer than that of attachment slot 7.

[1-2] Manufacturing Process

The work of attaching the band parts 6L and 6R to the sole in the slipper described above is performed according to a manufacturing process such as that described below.

(1) First, both upper sheet 4 and lower sheet 5 are cut as sheets that are slightly larger than the desired size. By weld-cutting, attachment slots 7 are made at prescribed positions of upper sheet 4 while forming waterproofing parts **10*b* at the same time. The welding of upper sheet 4 can be performed readily at this time since upper sheet 4** is made of polyvinyl chloride.

(2) Next, adhesive agent is applied to parts on the rear side of upper sheet 4 which are more outward than attachment slots 7. The top side of upper sheet 4 is then turned up and guide lines 65 of band parts 6L and 6R are placed over attachment slots 7.

(3) From this condition, the lateral edges of upper sheet 4 are turned up and band parts 6L and 6R are inserted through attachment slots 7 with the lateral edges of band parts 6L and 6R pointing outward. Band parts 6L and 6R can be inserted readily into attachment slots 7 at this time since the length of attachment slots 7 is longer than the lengths of the lateral edges of band parts 6L and 6R. The lateral edges of band parts 6L and 6R, which have been inserted into attachment slots 7, are then adhered and fixed to the lower face of upper sheet 4 by the adhesive agent applied to the rear side of upper sheet 4.

(4) Auxiliary or intermediate sheet 8 is then adhered and fixed to the lower face of upper sheet 4 by an adhesive agent in a manner whereby auxiliary sheet 8 will be in contact with the lower faces of band parts 6L and 6R, which have been inserted into attachment slots 7, and the lower face of upper sheet 4.

(5) Stitch 9 is then provided along the inner side of attachment slots 7 to sew auxiliary sheet 8 and the lateral edges of band parts 6L and 6R together. In order to sew the ends of the lateral edges of band parts 6L and 6R securely at this time, stitch 9 is sewn through one or two holes beyond the ends of the lateral edges of band parts 6L and 6R and then looped back again towards the ends.

(6) Adhesive agent is then applied over the entire lower face of upper sheet 4 and upper sheet 4 and lower sheet 5 are thereby adhered together.

(7) As a final step, upper sheet 4 and lower sheet 5 are cut into the desired size while forming waterproofing part **10*a* by weld-cutting. Welding of upper sheet 4 and lower sheet 5** can be performed readily at this time since these sheets are made of polyvinyl chloride.

[1-3] Effects

The slipper having the above arrangement will provide the following effects.

a. Improved Durability

Since stitch 9 is provided along attachment slot 7, the parts of stitch 9 at the upper faces of band parts 6L and 6R will be set within the depression of attachment slots 7. That is, the upper half of stitch 9 will not protrude above the upper face of upper sheet 4. Also, since the auxiliary sheet 8, to which stitch 9 is sewn, is covered from below by lower sheet 5, the lower half of stitch 9 will not be exposed from lower sheet 5. Stitch 9 is therefore prevented from being exposed to the exterior and will not become frayed. As a result, stitch 9 will not become cut even if the slipper is used over a long period of time. Band parts 6L and 6R will thus be prevented from becoming removed from upper sheet 4 and excellent durability can be obtained.

b. Improved Waterproofness

With the present preferred embodiment, although open parts will remain at the end parts of attachment slot 7 since attachment slot 7 is longer than the side edges of band parts 6L and 6R, since the length of auxiliary sheet 8 is longer than that of attachment slot 7, the abovementioned open parts can be sealed securely by auxiliary sheet 8. Moisture is thus prevented from entering between upper sheet 4 and lower sheet 5 from the end parts of attachment slot 7. Furthermore in this preferred embodiment, waterproofing parts **10*a* and 10*b* may be formed at the outer peripheral parts of upper sheet 4, lower sheet 5, and attachment slots 7 when these are formed by weld-cutting. Upper sheet 4, lower sheet 5, and attachment slots 7 may thus be waterproofed in a simple manner to thereby prevent the entry of moisture between upper sheet 4 and lower sheet 5**. Excellent waterproofness can thus be secured with the present preferred embodiment.

c. Securing of Quick Drying Properties

Since upper sheet 4, lower sheet 5, and the surfaces of band parts 6L and 6R are made of polyvinyl chloride in the present preferred embodiment, these parts exhibit strong water repellency and moisture can be wiped off immediately even if it becomes attached. Slippers can therefore be dried quickly after washing.

Since both waterproofness and quick drying properties are provided by the present preferred embodiment, degradation will not occur even upon frequent washing and drying will be easy. The present preferred embodiment is therefore particularly favorable for hotels, hospitals, and other environments where sanitation is important. Also, since upper sheet 4 and lower sheet 5 are both made of polyvinyl chloride in the present preferred embodiment, antibacterial processes can be applied readily. The slipper of this preferred embodiment is therefore sanitary. Furthermore, since band parts 6L and 6R can be folded parallely against upper sheet 4 with the present preferred embodiment, the preferred embodiment provides the effect where deformation of the band parts 6L and 6R will tend to occur less readily in the washing and drying work in comparison to conventional slippers in which the instep band is fixed in an arch-like shape.

d. Improved Comfort of Wearing

To wear the slipper of the present preferred embodiment, band parts 6L and 6R are raised together from upper sheet 4 and the front end parts 61 of joining slots 60 are brought in contact with each other. The two band parts 6L and 6R thus become a single instep band. At this point, the raised band parts 6L and 6R are joined only at the point of contact 63 at which the front end parts 61 of joining slots 60 contact each other. Band parts 6L and 6R are thus brought to the condition where the axial line extending from the toe side to the heel side of band parts 6L and 6R is rotatable up and down about point of contact 63. Band parts 6L and 6R will thus turn in the vertical direction in accordance with the height of the instep of a user when a user's foot is passed below the raised band parts 6L and 6R.

For example, in the case of a person with a high instep, the axial line joining the toe side and heel side of band parts 6L and 6R will be inclined steeply from the heel side towards the toe side (ie. the condition shown in FIG. 5). When the same slipper is worn by a person with a low instep, the axial line joining the toe side and heel side of band parts 6L and 6R will rotate about the point of contact 63 in the counterclockwise direction in the drawing and become nearly parallel to upper sheet 4 (ie. the condition shown in FIG. 6). Thus with the present preferred embodiment, band parts 6L and 6R may always be made to fit insteps of different heights. The slipper can thus accommodate various types of feet and provide excellent wearing comfort for all persons.

Furthermore, foam parts **4*b* and 5*b* are included in upper sheet 4 and lower sheet 5** of the present preferred embodiment to provide excellent cushioning for further wearing comfort.

e. Improved Portability and Storability

By parallely folding the band parts 6L and 6R against upper sheet 4, the band parts 6L and 6R may be prevented from being raised in an arch-like manner over upper sheet 4 and the thickness of the entire slipper can thus be restricted in the unused condition. Also, since the joining slots 60, which comprise the means for joining band parts 6R and 6L together, are formed integrally with band parts 6L and 6R, there is no need to provide a joining means for the band parts as a member apart from band parts themselves. Band parts 6L and 6R can thus be made even thinner.

With such a preferred embodiment, excellent storability is provided when the band parts 6L and 6R are folded and slippers may be piled and stored in large quantities in a narrow space. Since the slipper also becomes extremely thin, it is convenient to carry and exhibits excellent portability.

Furthermore with the present preferred embodiment, band parts 6L and 6R will not protrude beyond the outer periphery of upper sheet 4 when they are folded against upper sheet 4. The outer peripheral parts of band parts 6L and 6R are thereby prevented from becoming bent or deformed even when a plurality of slippers are piled together and the slipper becomes convenient to carry or stow away in a bag for storage. As a result, it becomes possible to pile together a plurality of slippers in a corrugated fiberboard box, etc. in an efficient manner and to thereby carry a large quantity of slippers at once. Such high storability and portability are extremely effective for carrying large quantities of slippers to a hotel, hospital, etc.

f. Improved Strength

With the sole arranged by adhering upper sheet 4 and lower sheet 5 together, the hard, thin top sheets **4*a* and 5*a* serve as the core. The sole is thereby provided with stiffness. Furthermore, since polyester sheets 6*a* are sandwiched in band parts 6L and 6R**, these parts are provided with high strength.

[1-4] Modified Example of the First Preferred embodiment

Figure 9:
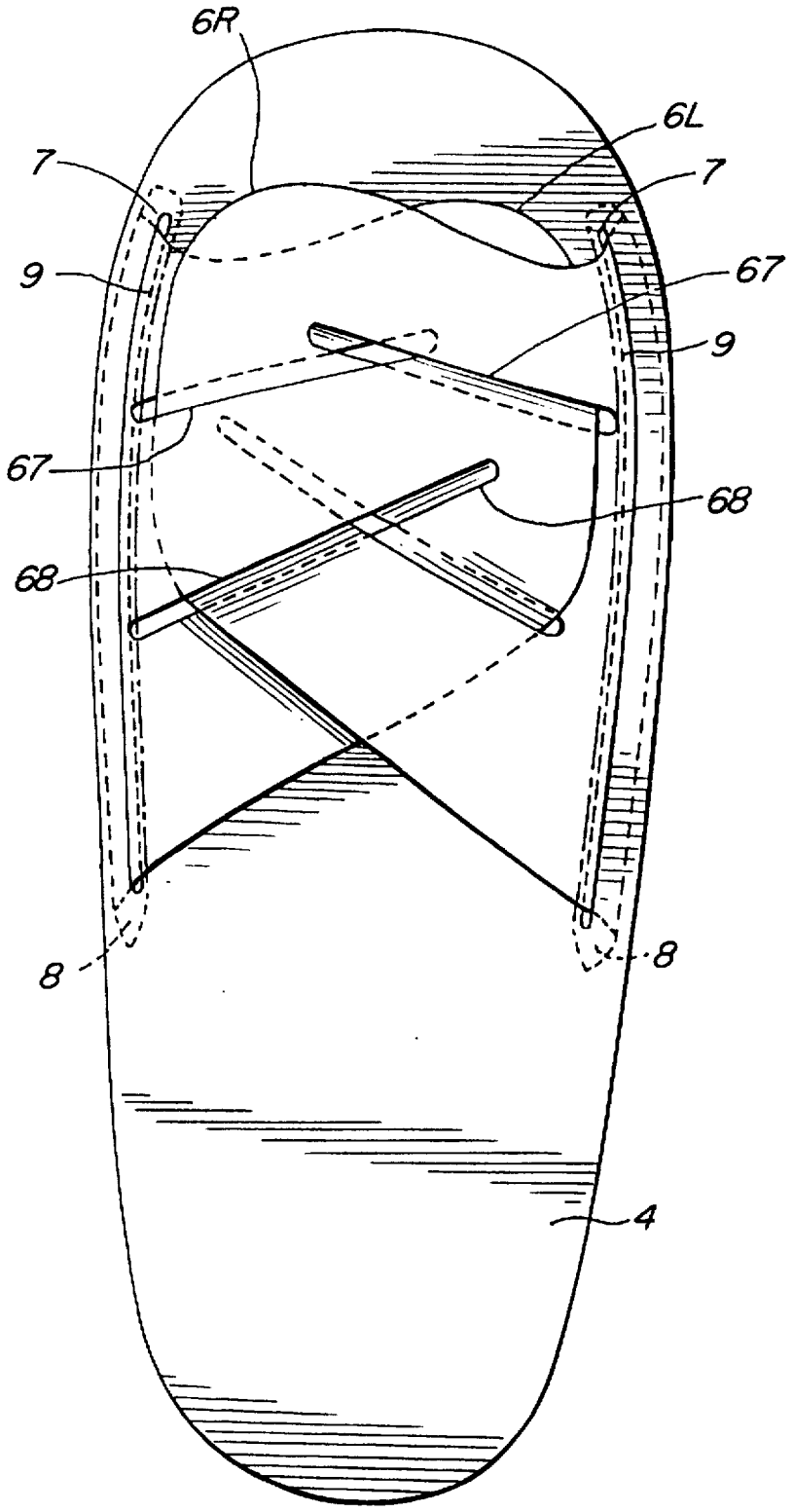
FIG. 9 is a plan view of a modified example of the first preferred embodiment related to the means for joining the band parts together.
Figure 10:
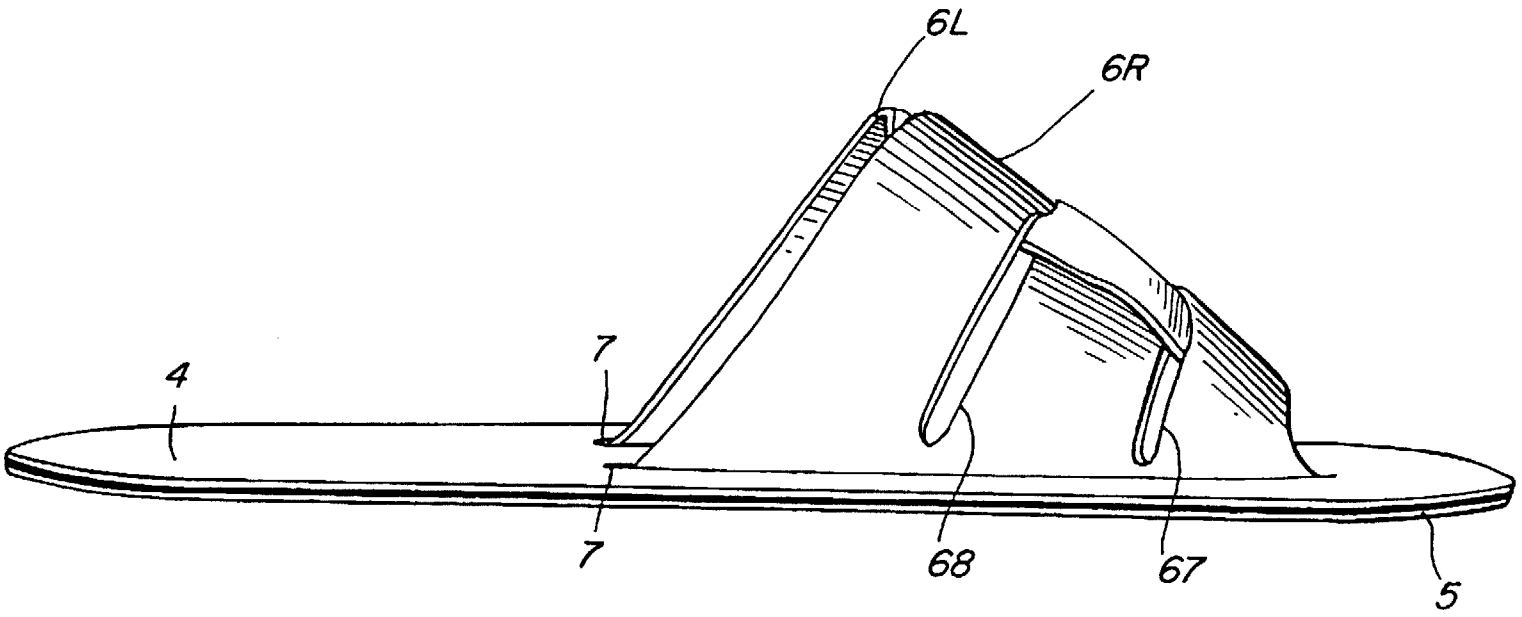
FIG. 10 is a side view of the modified example, shown in FIG. 9, of the first preferred embodiment related to the means for joining the band parts together.

[1-4-1] Modified Example Related to the Means for Joining the Band Parts Together A slipper in which the joining slots have been modified shall now be described as a modified example of the first preferred embodiment related to the means for joining the band parts together. FIG. 9 is a plan view of such an example and FIG. 10 is a side view of FIG. 9. With the slipper shown in these Figures, two nearly mutually parallel joining slots, ie. a first joining slot 67 (at the toe side) and a second joining slot 68 (at the heel side), are provided at each of band parts 6L and 6R and the first joining slots 67 of band parts 6L and 6R are joined to cross each other and the second joining slots 68 of band parts 6L and 6R are joined to cross each other. Such a preferred embodiment provides the same effects as those of the preferred embodiment described above.

Figure 11:
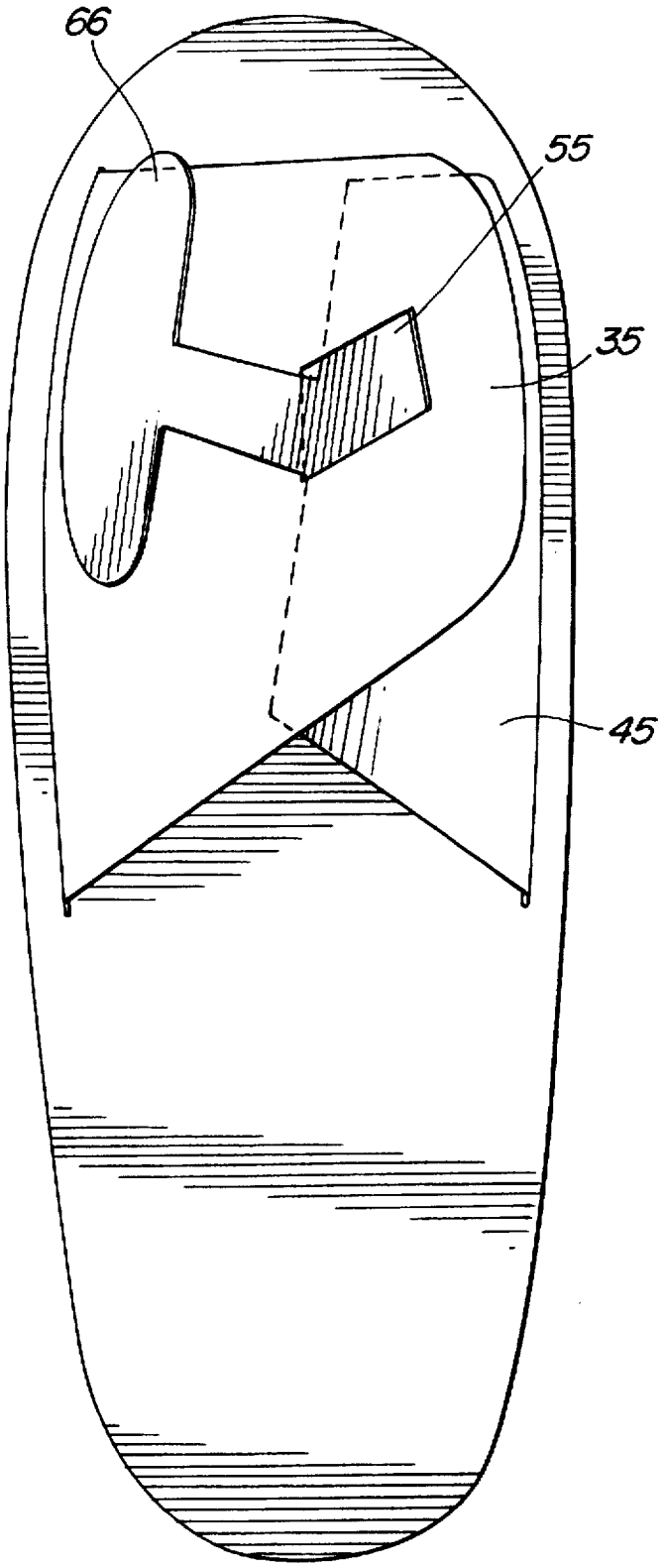
FIG. 11 is a plan view of a slipper having a joining hole and an inserted part, which is a modified example of the first preferred embodiment related to the means for joining the band parts together, and shows the condition where the band parts have been folded.
Figure 12:
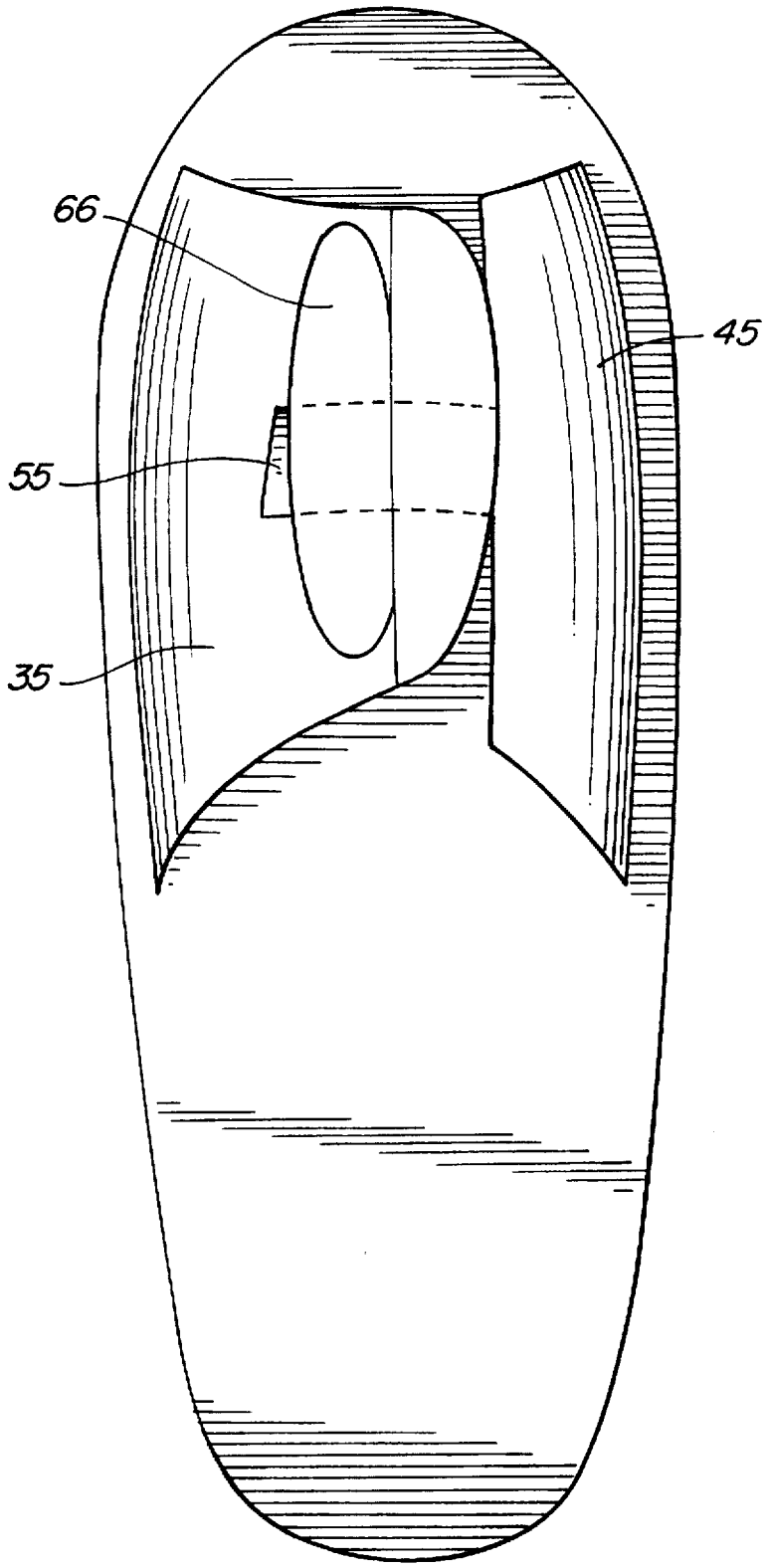
FIG. 12 is a plan view of a slipper having a joining hole and an inserted part, which is a modified example of the first preferred embodiment related to the means for joining the band parts together, and shows the condition where the band parts have been raised.
Figure 13:
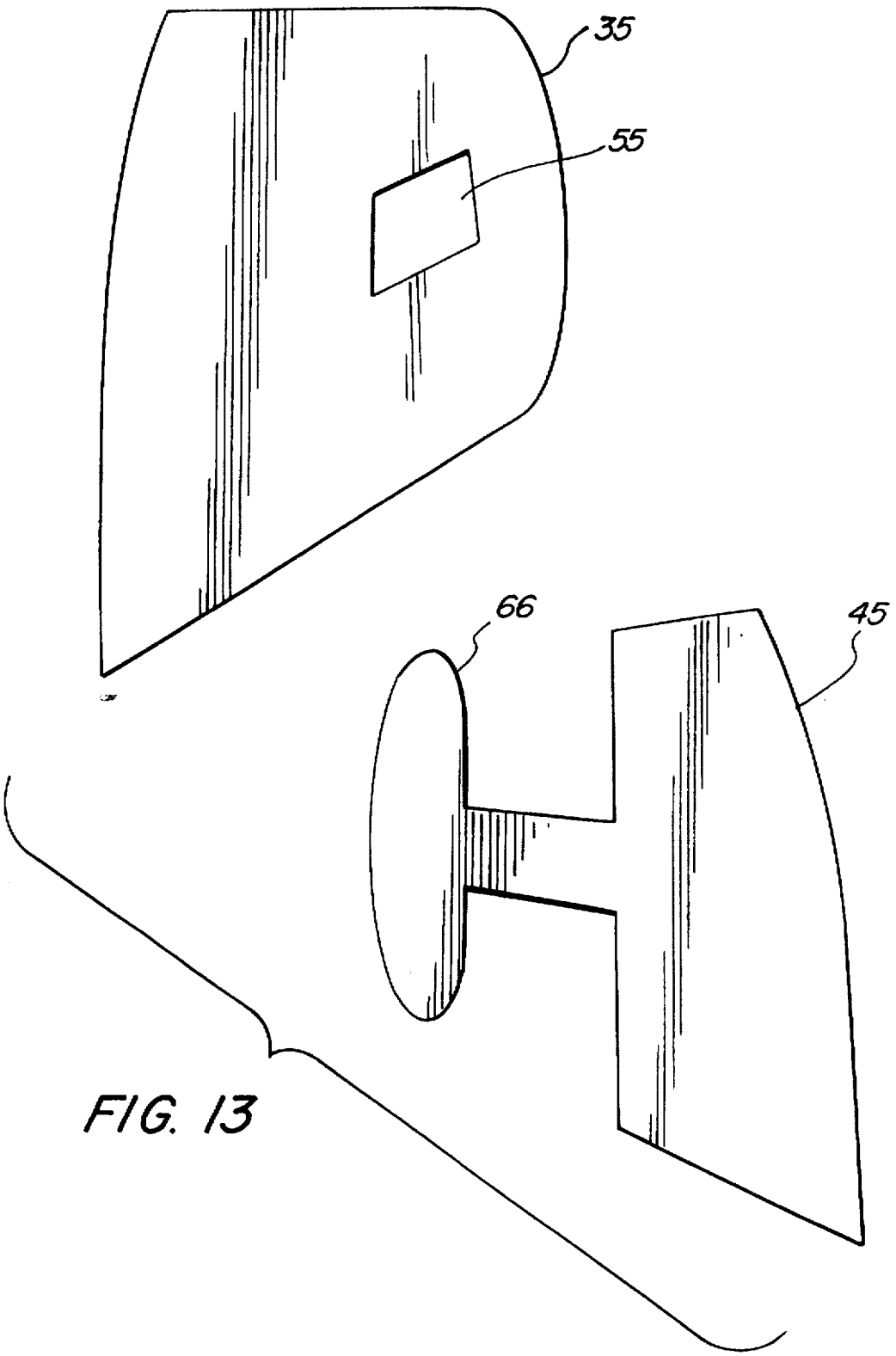
FIG. 13 shows plan views of the band parts in FIGS. 11 and 12.

A slipper having a joining hole and an inserted part shall now be described with reference to FIGS. 11–13 as a modified example of the first preferred embodiment related to the means for joining the band parts together. FIGS. 11 and 12 are plan views of such a slipper having a joining hole and an inserted part as a modified example of the first preferred embodiment related to the means for joining the band parts together. FIG. 11 shows the condition where the band parts have been folded and FIG. 12 shows the condition where the band parts have been raised. FIG. 13 shows plan views of the band parts in FIGS. 11 and 12. Members that are the same as those of the first preferred embodiment described above are provided with the same symbols and their description shall be omitted. Also, although the shape of the band parts differ from those of the first preferred embodiment, the material compositions shall be assumed to be the same.

As shown in FIGS. 11–13, band parts 35 and 45 are provided in the slipper that is a modified example of the first preferred embodiment related to the means for joining the band parts together. A joining hole 55 is formed on the right edge part of band part 35 (to the left side of the drawing). An inserted part 66, which is insertable in joining hole 55, is formed on band part 45 (to the right side of the drawing).

With such a slipper, the same effects as those of the first preferred embodiment described above are provided by the joining of band parts 35 and 45 by means of joining hole 55 and inserted part 66. That is, band parts 35 and 45 are joined only at the point of contact, at which joining hole 55 and inserted part 66 contact each other, and are thus made rotatable in the vertical direction. With such a slipper, the band parts 35 and 45 can be made to fit all types of instep heights and excellent wearing comfort can be provided.

[1-4-2] Modified Example Related to the Means for Attaching the Band to the Sole A modified example of the first preferred embodiment related to the means for attaching the band to the sole shall now be described with reference to FIG. 14.

Figure 14:
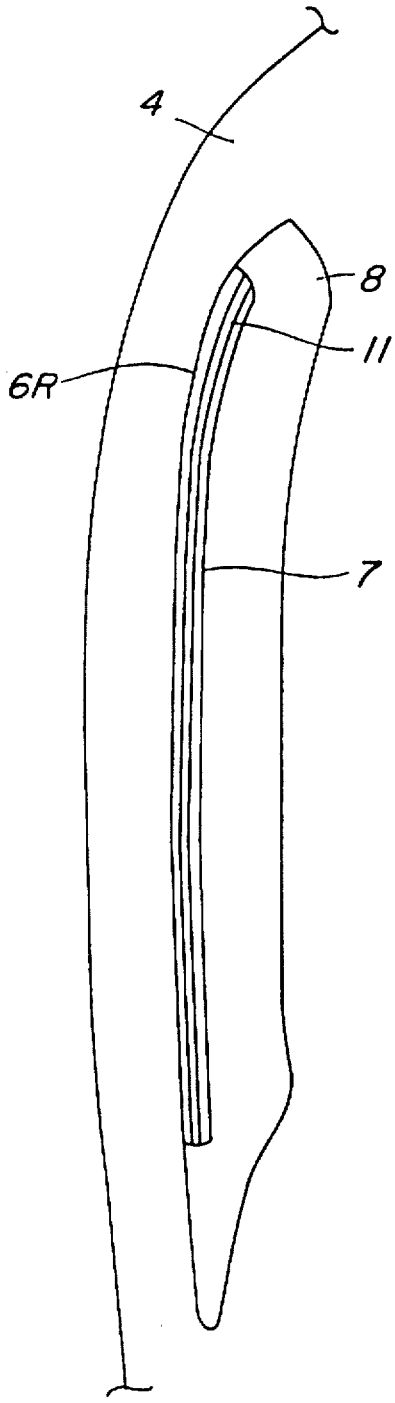
FIG. 14 is an enlarged bottom view of the major parts of a modified example of the first preferred embodiment related to the means for attaching the band to the sole.

As shown by FIG. 14, which is an enlarged bottom view of the major parts, the slipper, which is a modified example of the first preferred embodiment related to the means for attaching the band to the sole, has a welded part 11, for adhering the auxiliary sheet 8 with the lateral edges of band parts 6L and 6R, provided along attachment slot 7. With such a preferred embodiment, since welded part 11 is covered from the lower side by lower sheet 5, it is prevented from becoming exposed and worn. Band parts 6L and 6R are thus prevented from becoming removed from upper sheet 4 and excellent durability may be secured.

Also with such a preferred embodiment, since stitch 9 is not sewn at auxiliary sheet 8 and the lateral edges of band parts 6L and 6R, there are no holes in auxiliary sheet 8 nor in band parts 6L and 6R that are made for stitch 9. Therefore, the entry of moisture between upper sheet 4 and lower sheet 5 or into the interior of band parts 6L and 6R through such holes will not occur and the slipper will exhibit excellent waterproofness.

[1-4-3] Modified Example Related to the Arrangement of the Sole

The sole comprised of upper sheet 4 and lower sheet 5, which were used in the preferred embodiment described above, are sheets whose top and rear faces are made of the same material. Such sheets may not only be used for slippers but also for ensuring excellent waterproofness in sandales, boots, etc.

Figure 15:
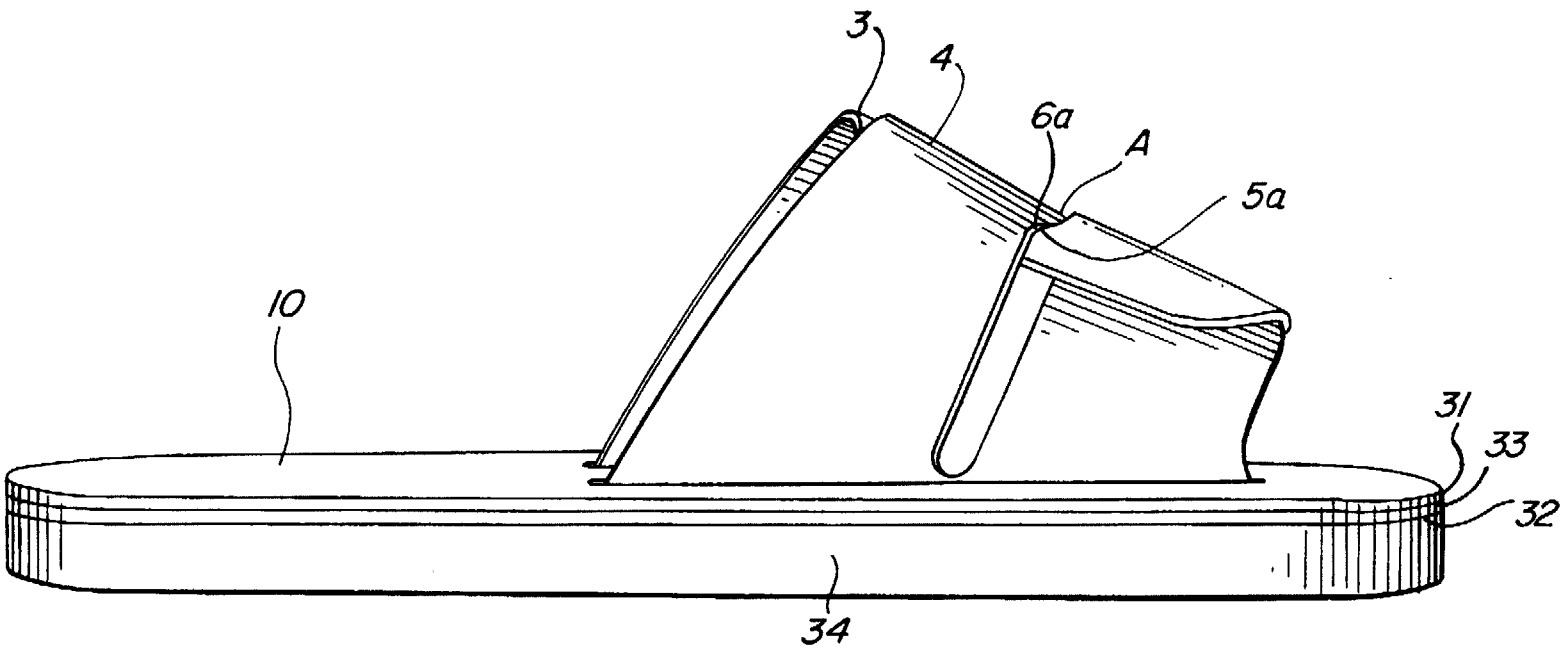
FIG. 15 is a plan view which shows the condition where a reinforcing sole has been attached to the bottom of the sole of the first preferred embodiment.

Also, as shown in FIG. 15, by attaching a reinforcing sole 34 to the bottom of sole 10, the slipper may be used to be worn outdoors like a sandal.

[2] Second Preferred embodiment

Figure 16:
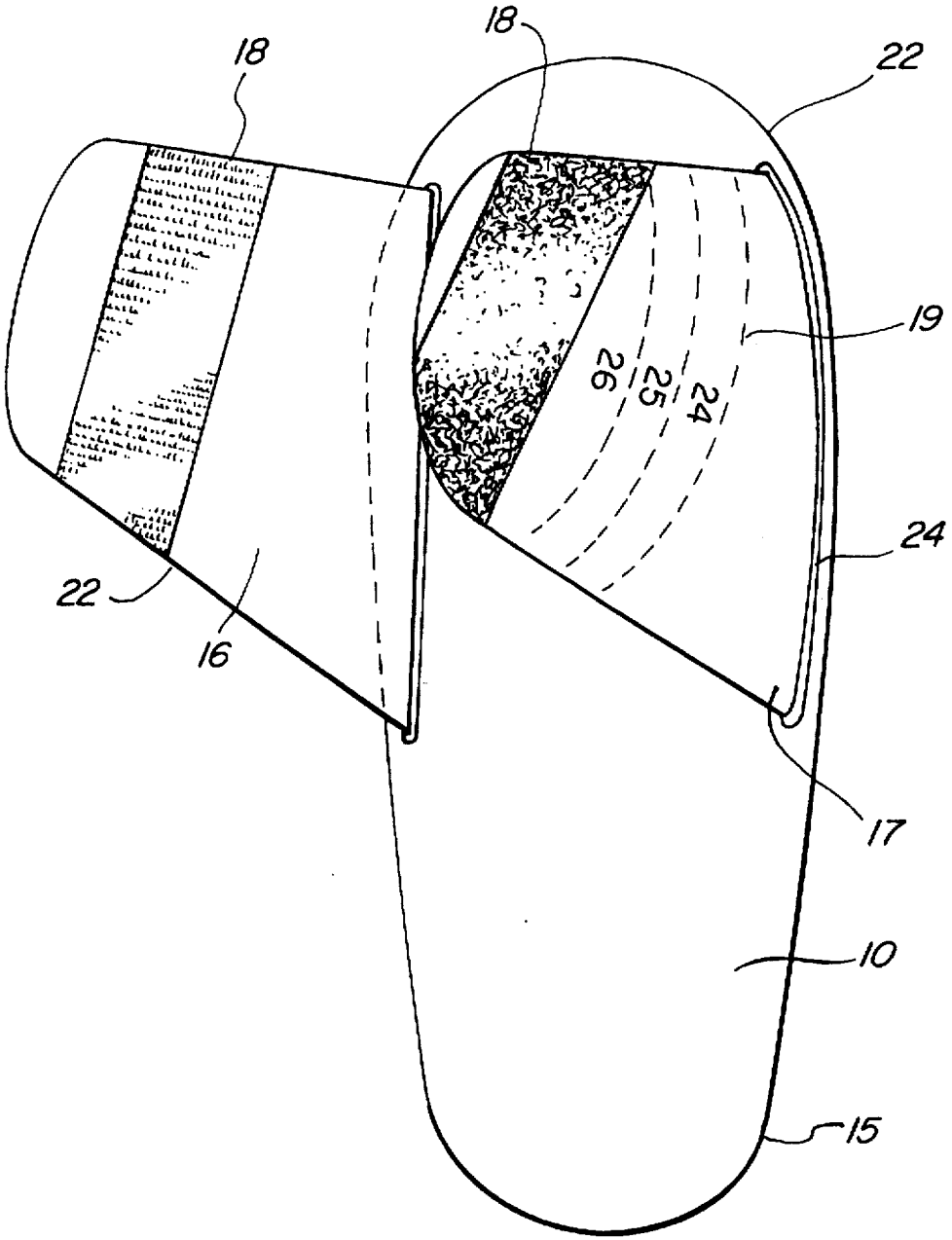
FIG. 16 is a plan view of the second preferred embodiment which shows the condition where one of the band parts has been unfolded.
Figure 17:
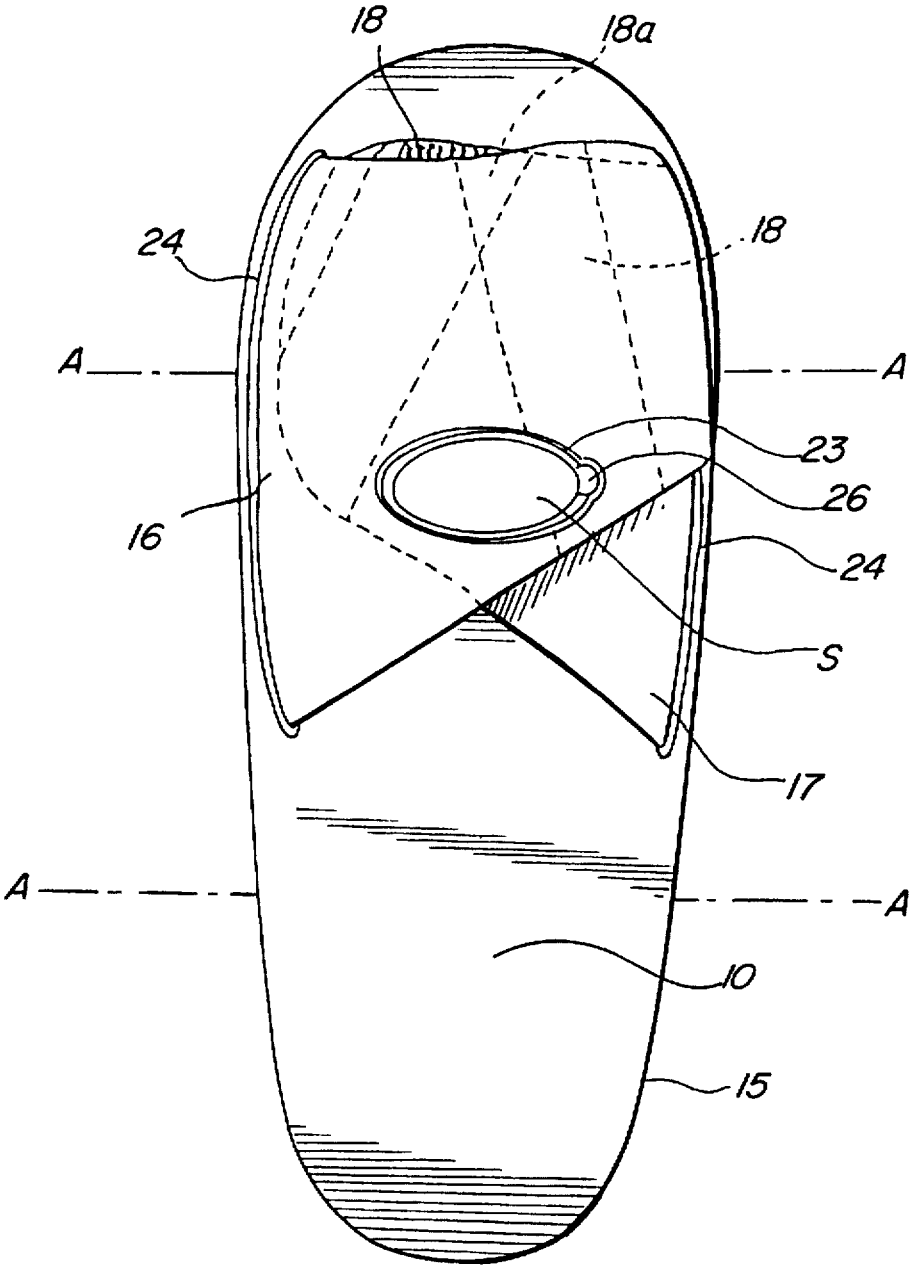
FIG. 17 is a plan view of the second preferred embodiment which shows the condition where both band parts have been folded.
Figure 18:
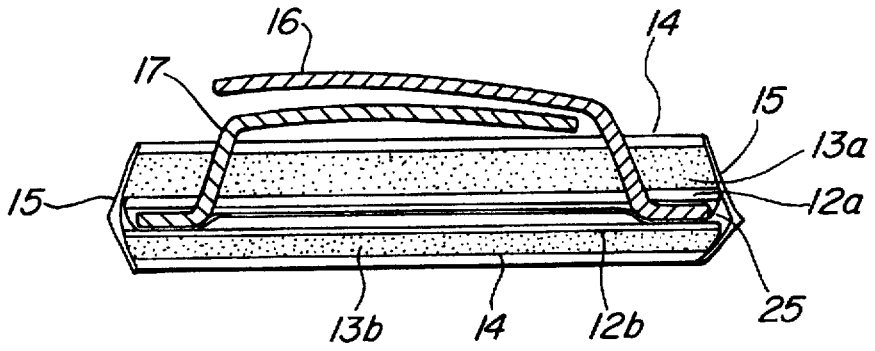
FIG. 18 is an enlarged cross section along line A—A of FIG. 17.
Figure 19:
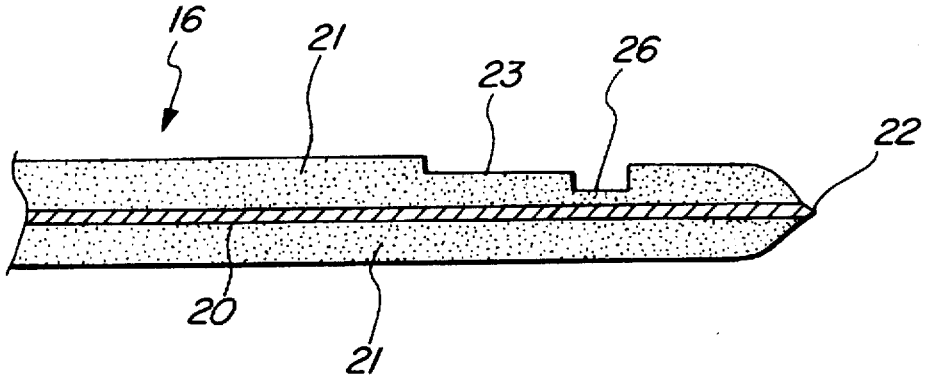
FIG. 19 is an enlarged cross section for explaining the cross-sectional arrangement of the band part.
Figure 20:
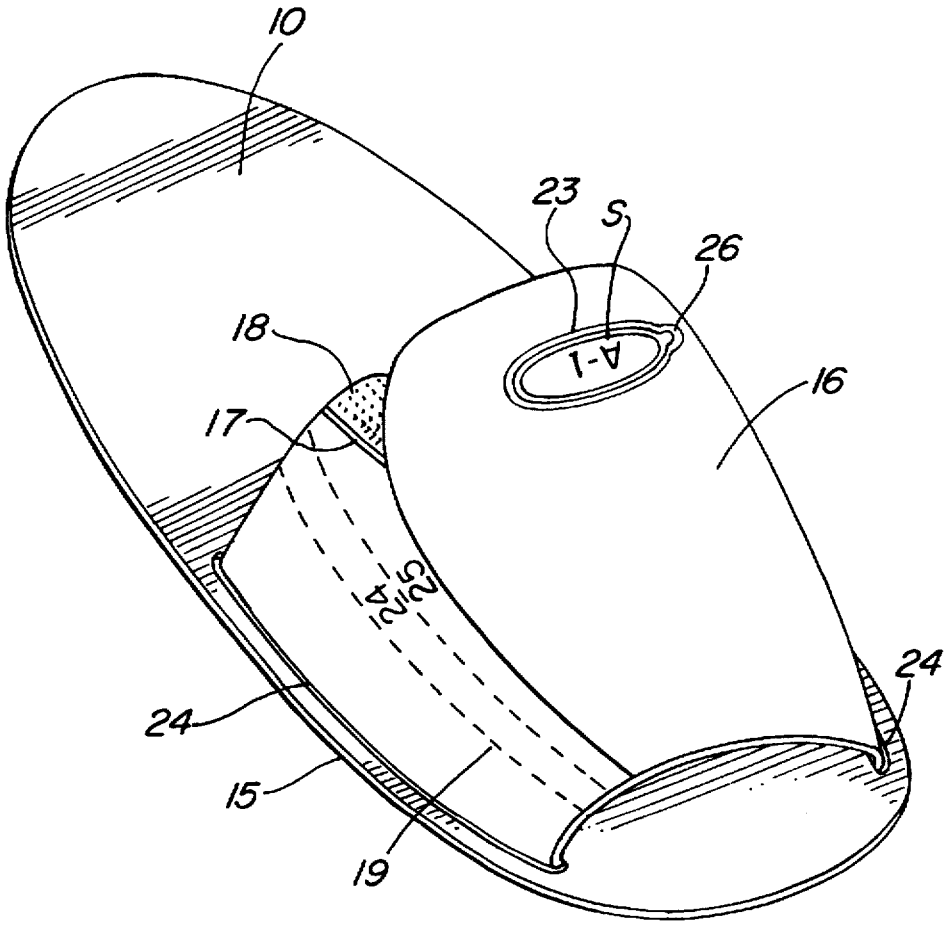
FIG. 20 is a perspective view showing the usage condition of the second preferred embodiment.
Figure 21:
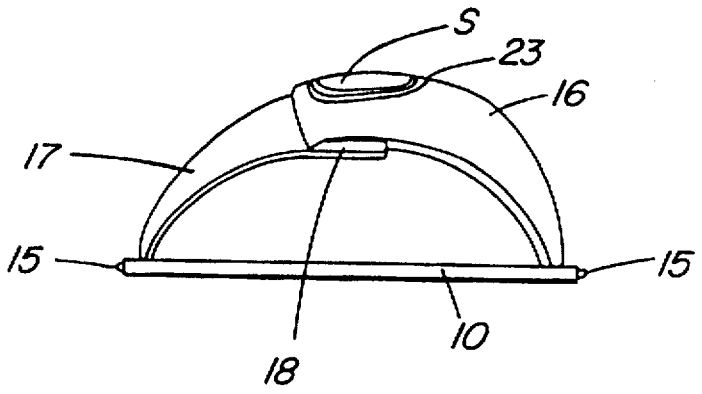
FIG. 21 is a front view of the usage condition shown in FIG. 20.
Figure 22:
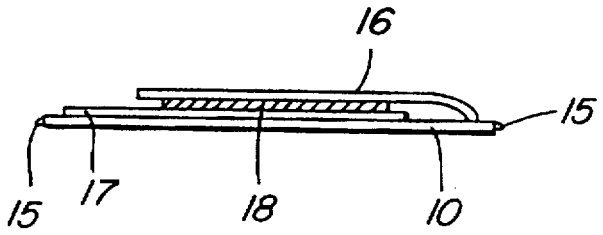
FIG. 22 is a front view of the condition, shown in FIG. 17, where both band parts have been folded.
Figure 23:
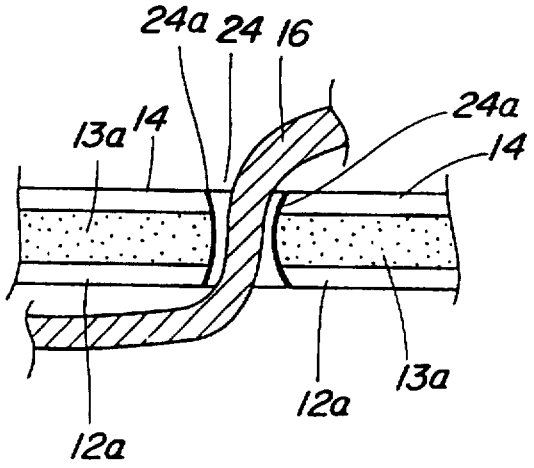
FIG. 23 is an enlarged cross section of the end part of a band part and the upper part of the sole.
Figure 24:
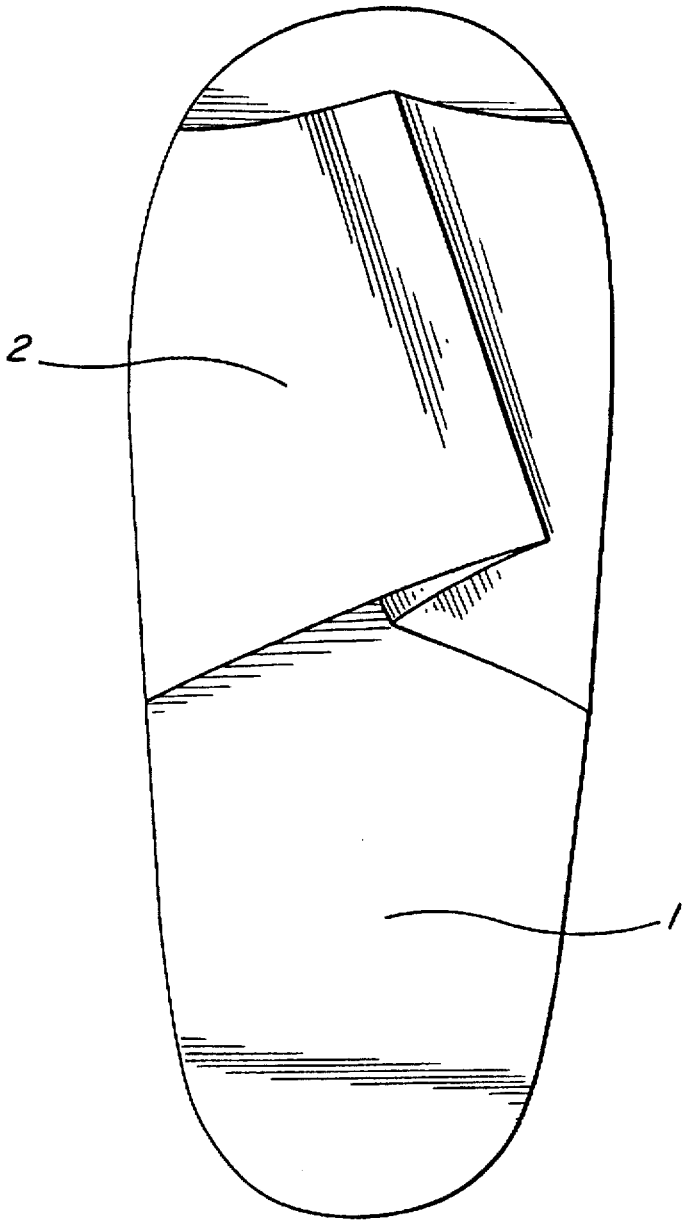
FIG. 24 is a plan view of a prior art slipper.
Figure 25:
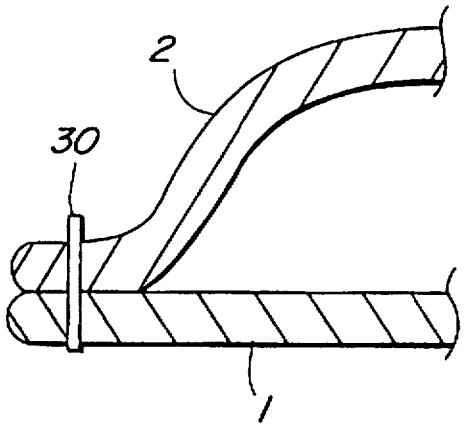
FIG. 25 is an enlarged cross section of a prior art slipper.

The second preferred embodiment of the present invention shall now be described in detail with reference to FIGS. 16–23. FIGS. 16 and 17 are plan views of the present preferred embodiment and FIG. 16 shows the condition where one of the band parts has been unfolded while FIG. 17 shows the condition where both band parts have been folded. FIG. 18 is an enlarged cross section for explaining the cross-sectional arrangement along line A—A of FIG. 17, FIG. 19 is an enlarged cross section for explaining the cross-sectional arrangement of the band part, FIG. 20 is a perspective view showing the usage condition of the present preferred embodiment, FIG. 21 is a front view of the usage condition shown in FIG. 20, FIG. 22 is a front view of the condition, shown in FIG. 17, where both band parts have been folded, and FIG. 23 is an enlarged cross section of the end part of a band part and the upper part of the sole.

[2-1] Arrangement

[2-1-1] Arrangement of Sole 10

As shown by FIGS. 16, 17, and 18, the slipper of the present invention is provided with a sole 10. Band parts 16 and 17 are attached respectively to the left side part and right side part of this sole 10. Sole 10 is comprised of a first (upper) cushion member **13*a* and a second (lower) cushion member 13*b*, which are adhered to each other, sheet-shaped cores 12*a* and 12*b*, which are respectively formed on the lower face of first cushion member 13*a* and the upper face of second cushion member 13*b*, and a surface sheet 14, which covers the first and second cushion members 13*a* and 13*b*. Sole 10 in FIG. 18 is shown with clearances being provided between core 12*a* and first cushion member 13*a* and between core 12*b* and second cushion member 13*b*** for the sake making the arrangement more clearly understood.

Cores **12*a* and 12*b* are formed from polyvinyl chloride sheets of high hardness while cushion members 13*a* and 13*b* are formed from polyvinyl chloride paste formed by a paste foaming process. Surface sheet 14 is formed from a polyvinyl chloride sheet which has been embossed. Furthermore, the outer peripheral part of sole 10 is welded by the weld-cutting of core 12, cushion members 13*a* and 13*b*, and surface sheet 14 and a waterproofing part 15** is arranged by this outer peripheral part.

[2-1-2] Attachment of Band Parts 16 and 17 to Sole 10

As shown in FIGS. 16, 17, 18, and 23, band parts 16 and 17 are fixed to the upper face of sole 10 with their end parts forming a slight curve so as to fit the foot of a user when the slipper is worn. To be specific, band parts 16 and 17 are fixed to sole 10 in the following manner. That is, insertion slots 24, through which the end parts of band parts 16 and 17 may be inserted, are formed on first cushion member **13*a* and surface sheet 14, which covers this cushion member, at positions that are about 5–10 mm to the inner side of the outer peripheral parts of first cushion member 13*a* and surface sheet 14. The end parts of band parts 16 and 17 are inserted through these insertion slots 24 in a manner whereby they are drawn towards the outer side of sole 10 and are then are sandwiched between first cushion member 13*a* and second cushion member 13*b* (to be more accurate, between cores 12*a* and 12*b*). Band parts 16 and 17 are then fixed to sole 10 by cores 12*a* and 12*b* becoming adhered together. At this point, a thin waterproofing sheet 25 is provided so as to cover the end parts of band parts 16 and 17, the first cushion member 13*a*, and the core 12*a* from the lower side. Also, as shown in FIG. 23, a waterproofing part 24*a* is formed at the inner peripheral part of insertion slot 24 by the weld-cutting process performed when insertion slot 24** is opened.

The band parts 16 and 17, which are attached to sole 10 in the above manner, can unfolded to the left and right about their lateral edges attached to sole 10 and can be folded against the upper face (top face) of sole 10. When band parts 16 and 17 are folded, band part 16 becomes the upper side, band part 17 becomes the lower side, and the outer peripheral parts of band parts 16 and 17 are prevented from protruding beyond the outer peripheral part of sole 10. Furthermore, band parts 16 and 17 can be folded nearly parallely against the upper face of sole 10.

[2-1-3] Arrangement of Band Parts 16 and 17

Band parts 16 and 17 are joined together to comprise the instep band of the slipper and, as shown in FIG. 19, are comprised of a nylon sheet 20, which is a woven sheet made of nylon, and a cushion member 21, which is made of polyvinyl chloride paste and is adhered to both sides of nylon sheet 20.

At the upper side of band part 16 is formed an elliptical seal attachment part 23 to which a seal S may be attached as shown in FIG. 17. This seal attachment part 23 is formed in a depressing manner by embossing, etc. and a small, circular depression 26, which is depressed even more than seal attachment part 23, is provided near the outer peripheral part of seal attachment part 23.

To the upper side of band part 17 are drawn three guide lines 19 as shown in FIG. 16. These guide lines 19 serve as guideline marks for adjusting the size of the instep band, arranged by the joining of band parts 16 and 17, by changing the amount by which band parts 16 and 17 overlap with each other and are gradual curves which match the shape of the right edge part of band part 16 when band parts 16 and 17 are joined. Here, guide lines 19 indicate the three stages which correspond to foot size 24, 25, and 26. Also, waterproofing parts 22 are formed at the outer peripheral parts of band parts 16 and 17 by the weld-cutting of these band parts 16 and 17.

[2-1-4] Arrangement of the Joining Means for Band Parts 16 and 17—See FIGS. 16, 17, and 20–22.

Velcro tapes 18 are disposed at the lower side of band part 16 and upper side of band part 17 as a means for joining band parts 16 and 17. These Velcro tapes 18 are provided with a certain width so that the size of the part at which band parts 16 and 17 overlap with each other may be changed. Velcro tapes 18 are also provided with fixing parts 18*a* which join and fix band parts 16 and 17 together at the position where they are folded against sole 10.

[2-2] Effects of the Second Preferred embodiment

The preferred embodiment with the above arrangement provides the following effects.

a. Thinning of the Slipper and Improved Storability and Portability

By the use of a sheet-shaped core 12, sole 10 can be made to have a thickness of about 4 mm. That is, sole 10 can be made adequately thin. Also, by parallely folding the band parts 16 and 17 against sole 10, the instep band is prevented from being raised in an arch-like manner over sole 10 and the thickness of the entire slipper can thus be restricted in the unused condition.

With such a slipper, excellent storability can be obtained in the condition wherein the band parts are folded and slippers can be piled and stored in large quantities in a narrow space. Also when band parts 16 and 17 are folded against sole 10, they will not protrude beyond the outer periphery of sole 10. Furthermore, since the fixing parts 18*a* of Velcro tapes 18 fix the band parts 16 and 17 in the condition where band parts 16 and 17 are folded against sole 10, band parts 16 and 17 will not flap around. The outer peripheral parts of band parts 16 and 17 will therefore be prevented from becoming bent or deformed even when a plurality of slippers are piled together. The slipper is thus made convenient to carry or stow away in a bag for storage. As a result, it becomes possible to pile together a plurality of slippers in a corrugated fiberboard box, etc. in an efficient manner and to thereby carry a large quantity of slippers at once. Such high storability and portability are particularly effective for carrying large quantities of slippers to a hotel, hospital, etc.

b. Improved Wearing Comfort

Since two cushion members 13*a* and 13*b* are provided at the interior of sole 10, the slipper will exhibit excellent cushioning. Furthermore, the surfaces of band parts 16 and 17 which come in direct contact with the user's foot is a soft cushion member 21. This provides a soft touch and improved wearing comfort.

c. Adjustment of the Instep Band

In the present preferred embodiment, the instep band is formed by joining band parts 16 and 17 together. In this process, the size of the instep band is adjusted by changing the size of the part at which the band parts 16 and 17 overlap with each other and Velcro tapes 18 are used to join band parts 16 and 17 when the instep band has been adjusted to a suitable size. The instep band can thus be changed readily in accordance with the foot size of the user and the user may thus be always provided with excellent wearing comfort.

Also with the present preferred embodiment, since band parts 16 and 17 can be joined using guide lines 19, provided on the surface of band part 17, as a guideline, the user may adjust the size of the entire instep band without having to perform the troublesome procedure of adjusting the instep band to the width of his/her foot after putting on the slipper. The slipper of the present preferred embodiment thus provides the benefit that although being of a type in which the instep band can be folded, it is extremely easy to wear. Furthermore, since Velcro tapes 18 are the joining means of the present preferred embodiment, the joining and removal process is performed readily and the mutually joined condition of band parts 16 and 17 can be changed easily.

d. Securing of Waterproofness

Since sole 10 and band parts 16 and 17 are made of polyvinyl chloride, they exhibit water repellency and since moisture can be wiped off immediately even when it gets attached, the slipper may be dried quickly. Also with the present preferred embodiment, waterproofing parts 15, 22, and 24*a* can be provided at the outer peripheral part of sole 10, the outer peripheral parts of band parts 16 and 17, and the inner peripheral part of insertion slot 24 by performing weld-cutting at these parts.

Furthermore with the present preferred embodiment, since a thin waterproofing sheet 25 covers the end parts of band parts 16 and 17 from the lower side, the entry of water into the sole from the upper sides of the end parts of band parts 16 and 17 (to be more specific, between the end parts of band parts 16 and 17 and the core 12*a*) can be prevented without fail.

As described above, by the present preferred embodiment, the peripheral parts of sole 10, band parts 16 and 17, and insertion slot 24 can be waterproofed at the same time as the cutting process and since these parts are made of polyvinyl chloride, they can be provided with quick drying properties. The slipper is thus provided with the benefits of not undergoing degradation even when water washed frequently and of being easy to dry. The slipper of the present preferred embodiment is therefore particularly favorable for hotels, hospitals, and other environments where sanitation is important. Also, unlike the instep bands of prior art slippers, the band parts 16 and 17, which become the instep band in the present preferred embodiment, are not always fixed to sole 10 in an arch-like manner. Band parts 16 and 17 are thus prevented from becoming deformed even when the slipper is washed.

e. Improved Strength

Since the cores 12*a* and 12*b* of sole 10 are made of polyvinyl chloride sheets with a high degree of hardness, sole 10 may be provided with stiffness. Also, since nylon sheets 20 are sandwiched in band parts 16 and 17, band parts 16 and 17 will not stretch even when stepping force is applied to these parts by the foot.

f. Improvements in External Design

With the present preferred embodiment, the end parts of band parts 16 and 17 are inserted in insertion slots 24 in a manner whereby the end parts are drawn towards the outer peripheral part of sole 10 upon attaching band parts 16 and 17 to sole 10. The end parts of band parts 16 and 17 are therefore prevented from becoming wavy even when they are slightly curved. If the end parts of band parts 16 and 17 become wavy, "wrinkles" may form on the upper and lower faces of the thin surface sheet 14. However since the end parts of band parts 16 and 17 are prevented from becoming wavy in the present preferred embodiment, "wrinkles" are prevented from forming at the upper and lower faces of surface sheet 14. The upper face of sole 10, which comes in contact with the user's foot, and the lower face of sole 10, which comes in contact with the floor surface, thus become flat to provide better wearing comfort and the external appearance of the slipper also becomes smooth to provide improvements in terms of design.

Also, since band parts 16 and 17 are attached with their end parts being pointed towards the outer side of sole 10, band parts 16 and 17 tend to tilt about their end parts toward sole 10. Band parts 16 and 17 may thus be folded readily against sole 10.

[3] Modified Example of the Second Preferred embodiment

Although the sole was comprised of two cushion members in the second preferred embodiment, the sole may be comprised of one cushion member instead.

[4] Modified Examples in Common to All Preferred embodiments

With regard to the positions of the band parts with respect to each other, either of the left and right band parts may come above the other band part. The slit part 64 may also be formed at either of the left and right band parts. The joining slot may take on a shape that becomes narrower towards the front side or a nearly L shape.

Effect of the Invention

With the invention described above, the wear of stitches may be prevented and durability may increased by a simple arrangement in which an auxiliary sheet is provided between the upper sheet and the lower sheet and in which the auxiliary sheet is sewn to the lateral edges of an instep band, which is inserted in attachment slots, and the waterproofness of the slipper is increased by the sealing of the open parts of the attachment slots. Also, wearing comfort may be ensured by using an upper sheet and a lower sheet which have a paste part. Furthermore, portability and storability may be increased by arranging the instep band from two band parts that may be folded against the sole.

What is claimed is:

1. A slipper with a sole and an instep band attached to this sole, said slipper being characterized in that the sole is comprised of an upper sheet and a lower sheet, having outer peripheral parts weld cut to render the sole waterproof attachment slots, into which lateral edges of the instep band are inserted are formed on the upper sheet by weld cutting with a waterproofing part provided at an outer peripheral part of the attachment slots, an auxiliary sheet is provided between the upper sheet and the lower sheet, said auxiliary sheet being in contact with the lower face of the instep band inserted in the attachment slots and the lower face of the upper sheet, the instep band having a left band member and a right band member pivotally attached at an intermediate attachment position to each other and expanded in an operational mode to receive a user's foot, said attachment position permitting the left band member and the right band member to be folded together to be approximately parallel to an upper surface of the sole in a storage mode;

pivot means for permitting the left band member and the right band member to pivotally rotate about an axis traverse to a longitudinal length of the sole member to permit an adjustment to the size of the user's foot; and a stitch, for sewing together the auxiliary sheet and the lateral edges of the instep band, is provided along each attachment slot.

2. A slipper as claimed in claim 1, wherein each of the two band parts is provided with a joining slot into which a part of the other band part is inserted, said joining slots being formed so that their front ends will come in contact with each other when the band parts are raised together.

3. A slipper with a sole and an instep band attached to this sole, said slipper being characterized in that the sole is comprised of an upper sheet and a lower sheet, having outer peripheral parts weld cut to render the sole waterproof attachment slots, into which the lateral edges of the instep band are inserted are formed in the upper sheet by weld cutting with a waterproofing part provided at an outer peripheral part of the attachment slots, an auxiliary sheet is provided between the upper sheet and the lower sheet, said auxiliary sheet being in contact with the lower face of the instep band inserted in the attachment slots and the lower face of the upper sheet, the instep band having a left band member and a right band member pivotally attached at an intermediate attachment position to each other and expanded in an operational mode to receive a user's foot, said attachment position permitting the left band member and the right band member to be folded together to be approximately parallel to an upper surface of the sole in a storage mode;

pivot means for permitting the left band member and the right band member to pivotally rotate about an axis traverse to a longitudinal length of the sole member to permit an adjustment to the size of the user's foot; and a welded part, for adhering the auxiliary sheet and the lateral edges of the instep band, is provided along each attachment slot.

4. A slipper as claimed in claim 1 or 3, wherein both the upper sheet and the lower sheet are comprised of a polyvinyl chloride sheet with a paste foam part.

5. A slipper for a human foot comprising:

a sole including an upper sheet with attachment slots, a lower sheet and an auxiliary sheet provided between the upper sheet and the lower sheet;

an instep band having lateral edges attached to the sole through the attachment slots, the auxiliary sheet contacting a lower surface of the instep band and a lower surface of the upper sheet;

means for fastening together the auxiliary sheet and the lateral edges of the instep band along each attachment slot; and welds provided between an outer peripheral part of each attachment slot and an outer peripheral part of the sole to waterproof seal a space between the upper sheet and the lower sheet.

6. The invention of claim 5, wherein the means for fastening are stitches sewed between the auxiliary sheet and the lateral edges of the instep band.

7. The invention of claim 5, wherein the means for fastening are welds adhering the auxiliary sheet and the lateral edges of the instep band.

8. An adjustable plastic slipper footware comprising:

a sole member having an upper plastic member with a foam core and a lower plastic member with a foam core the lower plastic member adheres to the upper plastic member about a periphery of the footware;

a collapsible plastic instep band assembly, extending through a pair of slots formed in the upper plastic member, is secured to the sole member, the instep band assembly having a left plastic band member and a right plastic band member pivotally attached at an intermediate point to each other and expanded in an operational mode to receive a user's foot, the left band member and the right band member are folded together to be approximately parallel to an upper surface of the sole member in a storage mode;

pivot means for permitting the left band member and the right band member to pivotally rotate about an axis traverse to a longitudinal length of the sole member to permit an adjustment to the size of the user's foot; and auxiliary sheets secured to the collapsible instep band assembly and positioned between the upper and lower plastic members, wherein the right plastic band member and the left plastic band member are welded water tight to the auxiliary sheets.

9. The invention of claim 8, wherein the pivot means includes a slot extending through the left band member and a slot extending through the right band member, the slots are interconnected and permit relative movement of the left band member and the right band member.

10. The invention of claim 8 wherein the foam core is a polyvinyl chloride material.

11. The invention of claim 8 wherein the right band member and the left band member are of a shape that, when folded into a storage mode the right band member and the left band member do not protrude from an outer periphery of the sole member.

12. The invention of claim 8 wherein a reinforcing sole is attached to the bottom of the sole member to enable the slipper footware to be worn outdoors.

13. The inventions of claim 8 wherein the left and right plastic band members have a foam core.

* * * * *